US006358144B1

(12) United States Patent
Kadlic et al.

(10) Patent No.: US 6,358,144 B1
(45) Date of Patent: Mar. 19, 2002

(54) BONUS JOKER POKER

(75) Inventors: Thomas P. Kadlic; Constance A. Kadlic, both of Columbus, GA (US)

(73) Assignee: WSK Gaming LLC, Las Vegas, NV (US)

( * ) Notice: Subject to any disclaimer, the term of this patent is extended or adjusted under 35 U.S.C. 154(b) by 0 days.

(21) Appl. No.: 09/451,908

(22) Filed: Dec. 1, 1999

Related U.S. Application Data

(63) Continuation-in-part of application No. 09/056,898, filed on Apr. 7, 1998, now Pat. No. 6,135,882, which is a continuation of application No. 08/850,625, filed on May 2, 1997, now Pat. No. 5,816,915.

(51) Int. Cl.[7] ..... A63F 1/00; A63F 13/00

(52) U.S. Cl. ..... 463/13; 273/292; 273/274; 273/306

(58) Field of Search ..... 273/292, 274, 273/309, 306; 463/13, 12

(56) References Cited

U.S. PATENT DOCUMENTS

| | | | | |
|---|---|---|---|---|
| 5,356,140 A | | 10/1994 | Dabrowski et al. | 273/85 |
| 5,486,005 A | | 1/1996 | Neal | 273/292 |
| 5,573,249 A | | 11/1996 | Johnson | 273/292 |
| 5,664,781 A | | 9/1997 | Feola | 273/292 |
| 5,732,950 A | * | 3/1998 | Moody | 273/292 |
| 5,823,873 A | | 10/1998 | Moody | 463/13 |
| 6,098,985 A | * | 8/2000 | Moody | 273/292 |

FOREIGN PATENT DOCUMENTS

| | | |
|---|---|---|
| WO | WO 97/32285 | 9/1997 |

* cited by examiner

*Primary Examiner*—Benjamin H. Layno
(74) *Attorney, Agent, or Firm*—Quirk & Tratos

(57) ABSTRACT

An electronic video draw poker machine is provided with a multi-hand screen display that can show a plurality of five card draw poker hands. A separate five card poker hand is displayed in each quadrant of the screen display with each five card hand being dealt from its associated, separate deck of playing cards. The initial deal of each five card hand is two cards face up and three cards face down. The player selects one of the sets of two face up cards to continue play. After the player has selected which set of two face up cards he wishes to play, the selected two face up cards are duplicated into the other three hand positions to replace the two face up cards in that hand position. The remaining face down cards in each hand are then revealed. The game then continues in the conventional manner with the player discarding and drawing replacement cards with respect to each of the four separate five card hands in an attempt to improve each hand. After the draw step is completed, each of the final five card hands are compared to a pay table based on poker hand ranking to determine if the player has achieved a winning combination. The amount of the payout to the player for a winning combination is based on the number of coins, tokens or credits wagered by the player and the type of winning hand achieved.

60 Claims, 27 Drawing Sheets

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET 1 | 2 | 3 | 4 | 5 |
|---|---|---|---|---|---|
| ROYAL FLUSH | 250 | 500 | 750 | 1000 | 4000 |
| STRAIGHT FLUSH | 50 | 100 | 150 | 200 | 250 |
| 5 OF A KIND | 200 | 400 | 600 | 800 | 1000 |
| WILD ROYAL | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

BONUS JOKER POKER

CROSS-REFERENCE TO RELATED APPLICATIONS

This application is a Continuation in Part of application Ser. No. 09/056,898 entitled "Pick One Poker," filed Apr. 7, 1998, now U.S. Pat. No. 6,135,882, which is a Continuation of application Ser. No. 08/850,625 entitled "Pick One Poker," filed May 2, 1997, now U.S. Pat. No. 5,816,915.

FIELD OF THE INVENTION

This invention relates to a single player poker game, and more particularly to a single player poker game that can be played as an electronic video poker game or as a live table game and in which the player has the option to select one of four separate, initial hands. The four separate, initial hands can be dealt from a single deck of cards or from four separate decks of cards. The player then selects one of the four separate, initial hands to play. The player plays out the selected hand as a draw poker hand. During the play of the hand, such as on either the initial deal of cards or on the deal of replacement cards, the player may also randomly receive a "Red" Joker or a "Black" Joker or both Jokers in a separate portion of the video screen display.

If, at the end of the play of the hand, the player has received a "Red" Joker or a "Black" Joker or both Jokers, the player is awarded a bonus feature in which the Joker is substituted seriatim for each card in the hand that corresponds to the color of the Joker. A poker hand ranking is determined for each instance of substitution of the Joker and the player receives additional payouts in accordance with the pay table.

The method of the present invention can be played as a casino wagering game or, alternatively, the method of the present invention can also be displayed on a non-wagering amusement device.

BACKGROUND OF THE INVENTION

There have been many types of electronic video gaming machines that have been developed. The electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A payout table is established based on the number of coins wagered by the player and the type of poker hand achieved.

The classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

U.S. Pat. No. 5,356,140 (the disclosure of which is incorporated herein by this reference) discloses a method of play of a game generally referred to as "Double Poker". In this method of play, a player makes a wager to participate in the game and the player is dealt two distinct hands at the beginning of the game. Each hand is dealt from its own separate complete deck of cards and all five cards in each hand are dealt face up. The player selects one of the hands to play and the unselected hand is voided or removed from use. The player plays out the selected hand according to the conventional manner of play of traditional video poker games by discarding and receiving replacement cards. All replacement cards are dealt from the particular initial deck of cards from which the first five cards were dealt. The player wins or loses based on a payout schedule applied to preselected winning hand combinations and based on the number of coins wagered by the player.

The method of play disclosed in this '140 patent has the drawback that the player only has two initial five cards hands to choose from and all five cards of each hand are displayed to the player.

WO 97/32285 discloses a gaming machine, that can be a video poker machine, which includes a special feature that is invoked when a special triggering combination of symbols occurs. The special feature is a wild card symbol that moves around the screen progressively replacing each symbol in the display. In connection with video poker, the example given is that an Ace in the first card position of a five card hand and a Club in the last card position of a five card would trigger the special feature. If the special feature is triggered, the wild card symbol would then be displayed sequentially in each card position and acts as a wild card in combination with the remaining cards of the hand. The player receives a prize for each new winning combination created by the wild card.

It is an object of the present invention to provide a new form of video poker game that gives the player a bonus feature on a randomly occurring basis during the play of the game.

It is a feature of the present invention to provide a multi-hand screen display which initially displays to the player four separate five card hands. Each hand is displayed with two cards face up and three cards face down. During the initial deal of these cards, either a "Red" Joker or a "Black" Joker may be randomly displayed to the player. The player selects one of the sets of two face up cards to play. After the player has selected one of the sets of two face up cards to play, the face down cards in the selected hand are then revealed so that the player can see all five cards of the hand. The player then discards any unwanted cards and receives replacement cards in the selected hand. During the dealing of the replacement cards, again either a "Red" Joker or a "Black" Joker may be randomly displayed to the player. The resulting final five card hand is compared to a payout schedule to determine if the player has achieved a winning hand combination. If the player has also received a "Red"

Joker or a "Black" Joker or both Jokers, the player then receives a bonus feature in which the Joker becomes a wild card and is substituted seriatim for each card in the final five card hand that corresponds to the color of the Joker. A poker hand ranking is determined for each instance of substitution of the Joker and the player receives additional payouts in accordance with the pay table.

It is an advantage of the present invention that the player is given multiple options at the beginning of the game to select what the player perceives is the best possible potential hand and to receive, on a random basis, a wild card that is used when the play of the hand is complete to receive additional bonus payouts.

It is a further advantage of the present invention that the player is provided multiple initial starting hands so that the player has the opportunity to maximize his winnings when he is dealt a good starting hand and, when the player receives a wild card, to dramatically increase the winnings received by the player.

Other objects, features and advantages of the present invention will become apparent from a consideration of the following detailed description.

SUMMARY OF THE INVENTION

An electronic video draw poker machine is provided with a multi-hand screen display that can show a plurality of five card draw poker hands at the same time. In the preferred embodiment, four separate five card draw poker hands are displayed. A separate five card poker hand is displayed in each quadrant of the screen display with each five card hand being dealt from its associated, separate deck of playing cards. In the preferred embodiment of the present invention, the initial deal of each five card hand is two cards face up and three cards face down.

The player selects one of the initial five card hands to continue play. After the player has selected which initial five card hand he wishes to play, the remaining face down cards in the selected hand are revealed. The game then continues in the conventional manner of a draw poker game with the player discarding and drawing replacement cards with respect to the selected five card hand in an attempt to improve that hand. After the draw step is completed, the final five card hand is compared to a pay table based on poker hand ranking to determine if the player has achieved a winning combination. The amount of the payout to the player for a winning combination is based on the number of coins, tokens or credits wagered by the player and the type of winning hand achieved.

During the initial deal of the initial hands of cards or during the deal of replacement cards during the draw step of the method of play, either a "Red" Joker or a "Black" Joker or both may be randomly displayed to the player in a separate location on the screen display. If the player receives either a "Red" Joker or a "Black" Joker or both, the player then receives a bonus feature in which the Joker becomes a wild card and is substituted seriatim for each card in the final five card hand that corresponds to the color of the Joker. A poker hand ranking is determined for each instance of substitution of the Joker and the player receives additional in payouts in accordance with the pay table.

Alternatively, the player may make four wagers at the beginning of the play of a round of the game. Each wager is allocated to a separate hand. Four separate five card draw poker hands are displayed; the initial deal of each five card hand is two cards face up and three cards face down.

The player then selects one of the sets of two face up cards to continue play. After the player has selected which set of two face up cards he wishes to play, the face up cards are substituted into the other three hands in place of the original face up cards. The remaining face down cards in each hand are then revealed. The game then continues in the conventional manner with the player discarding and drawing replacement cards with respect to the each of the five card hands in an attempt to improve each hand.

After the draw step is completed, the final five cards of each hand are compared to a pay table based on poker hand ranking to determine if the player has achieved a winning combination. The amount of the payout to the player for a winning combination is based on the number of coins, tokens or credits wagered by the player and the type of winning hand achieved.

During the initial deal of the initial hands of cards or during the draw step in which replacement cards are dealt, either a "Red" Joker or a "Black" Joker or both may be randomly displayed to the player in a separate location on the screen display. If the player has also received a "Red" Joker or a "Black" Joker or both, the player then receives a bonus feature in which the Joker becomes a wild card and is substituted seriatim for each card in each final five card hand that corresponds to the color of the Joker. A poker hand ranking is determined for each instance of substitution of the Joker and the player receives additional payouts in accordance with the pay table.

Alternatively, instead of using separate decks of playing cards for each hand, all of the initial hands can be dealt from a single deck of playing cards. After the player selects which of the initial hands the player wishes to play, all of the cards from the non-selected hands are returned to the deck to be available as possible replacement cards during the draw step.

DETAILED DESCRIPTION OF THE PREFERRED EMBODIMENTS

Figure 1:
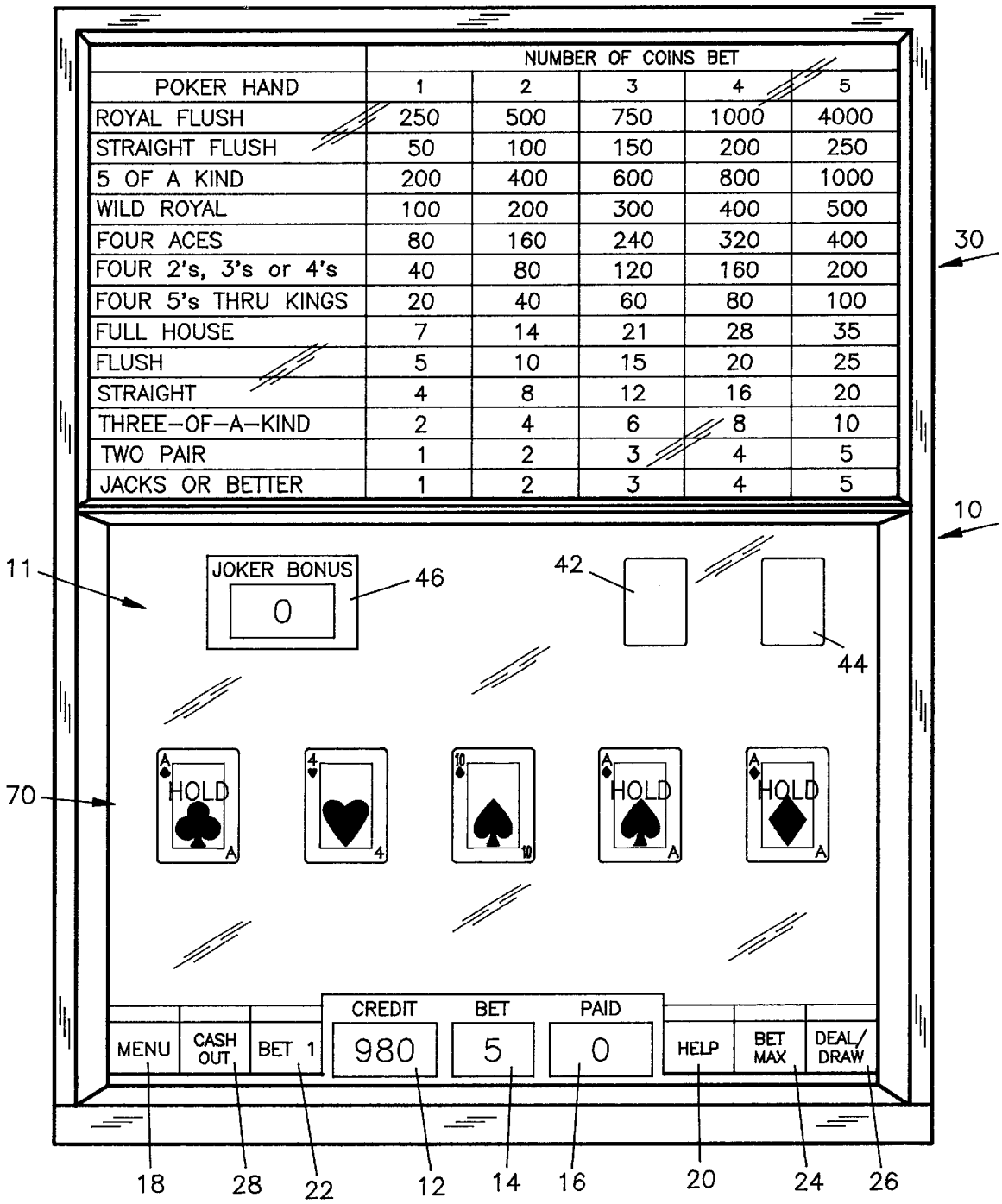
FIG. 1 shows a typical screen display and payout table used in one embodiment of the method of the present invention, including an example of an initial deal of the cards.

FIG. 1 shows the front of a gaming cabinet 10 for an electronic video poker machine programmed to operate in accordance with the method of play in the present invention.

As is conventional in gaming machines of this type, a player wagers one or more coins, tokens, paper currency or credits to activate the game. A coin acceptor or a currency acceptor is provided as is conventional to allow the player to insert coins, tokens or currency to activate the game. In addition to using coin/token acceptor mechanisms or currency acceptor mechanisms or both, the method of the present invention is intended to also include credit coupons, credit or debit card systems, magnetically or optically read memory storage cards or any other apparatus or system by which monetary value can be input by the player and eventually displayed on the credit display on the gaming machine.

Also as is conventional, the gaming cabinet includes a screen display 11 that can be any suitable video technology in either touch screen format or non-touch screen format. FIG. 1 shows a screen display in touch screen format and at any suitable location, such as in the lower portion of the video screen 11, there is provided a display location for the credit meter 12 which accrues credits available to the player to play the game and which accrues credits won by the player during the play of the game. Another display location has the bet meter 14 which shows the number of credits wagered by the player during a particular play of the game. At still another location there is a pay meter 16 which shows the number of credits paid to the player when the player achieves a winning play. Any suitable meter devices may be used to show the credits accrued by the player, the amount bet by the player and the amount won by the player.

In the preferred embodiment of the present invention, a plurality of touch screen locations, using conventional touch screen display technology, are also provided on the screen display 11 to allow the player to operate the gaming machine. These touch screen locations can include a "Menu" location 18 which allows the player to call up a screen display from which the player may select from the game menu which type of game the player wishes to play. The method of play of the present invention is designed to operate on a multi-game gaming machine which can include the various embodiments of the present invention as well as other video games if desired. The "Help" location 20 allows the player to call up a screen display that provides information to the player about the game variation that the player wishes to play. The use of a "Menu" location 18 and a "Help" location are conventional in multi-game gaming machines.

The screen display 11 also includes a "Bet 1" location 22 and a "Bet Max" location 24, which are also both conventional and allow the player to determine the amount of the wager the player intends to make. A "Deal/Draw" location 26 allows the player to activate the initial deal and the subsequent draw of replacement cards as is appropriate during the play of the game. A "Cash Out" location 28 is also provided so that when the player wins an award or otherwise decides to stop playing the game, the player can be paid his accrued winnings either by means of a coin hopper that dispenses coins or tokens to the player or any of the other myriad devices and apparatus that are available to pay a winning player. The amusement version of the method of play would not require a wager to be made in order to play the game.

Instead of using designated locations on a touch screen display, a manual activated button panel may be used that provides the buttons that can be used by the player to operate the gaming machine.

In the preferred embodiment of the present invention, the gaming machine 11 also includes a pay table 30 which shows the amounts that may be won by the player based on the poker hand ranking and the number of credits wagered by the player. The pay table 30 may be shown on a portion of the screen display 11 or the pay table may be printed on the glass portions of the gaming cabinet.

The screen display 11 also has an area in which the four initially dealt hands, designated as HAND ONE, HAND TWO, HAND THREE and HAND FOUR, respectively, are displayed. Four standard decks of playing cards are used; each of the four hands being associated with one of the four decks. After each of the four separate decks are electronically shuffled, an initial five card hand is dealt from each separate deck of playing cards and displayed in each of the quadrants of the screen display. For example, HAND ONE 60 is dealt from Deck #1, HAND TWO 70 is dealt from Deck #2, HAND THREE 80 is dealt from Deck #3 and HAND FOUR 90 is dealt from Deck #4.

As shown in FIG. 1, each five card hand has two cards dealt face up and the other three cards dealt face down. Which of the particular cards are face up or face down is not critical, as long as in this preferred embodiment each hand has two cards face up and three cards face down. Other embodiments of the present invention can utilize a different number of face up cards and face down cards: such as three cards face up—two cards face down; or four cards face up and one card face down; or one card face up and four cards face down. However, the most preferred embodiment of the present invention is as shown in FIG. 1 in which each hand has two cards face up and three cards face down.

After the initial deal of these four separate hands, the player selects which one of the four hands the player wishes to play for that round of play. This selection can be accomplished by pressing an appropriate button provided on a conventional button panel on the cabinet of the gaming machine 10 or by simply pressing the screen display 11 at the location of the desired hand, using conventional touch screen technology that is widely available in gaming devices of this type.

With reference to FIG. 1, an example of an initial deal of four hands is shown. HAND ONE 60 has the King of Clubs, the Nine of Hearts and three face down cards. HAND TWO 70 has the Ace of Spades, the Ace of Diamonds and three face down cards. HAND THREE 80 has the Six of Clubs, the Four of Hearts and three face down cards. HAND FOUR 90 has the Ten of Spades, the Seven of Clubs and three face down cards. While the player may select any of the four hands as the hand to play, the player in this example would most likely select HAND TWO 70 since this hand a pair of Aces.

Figure 2:
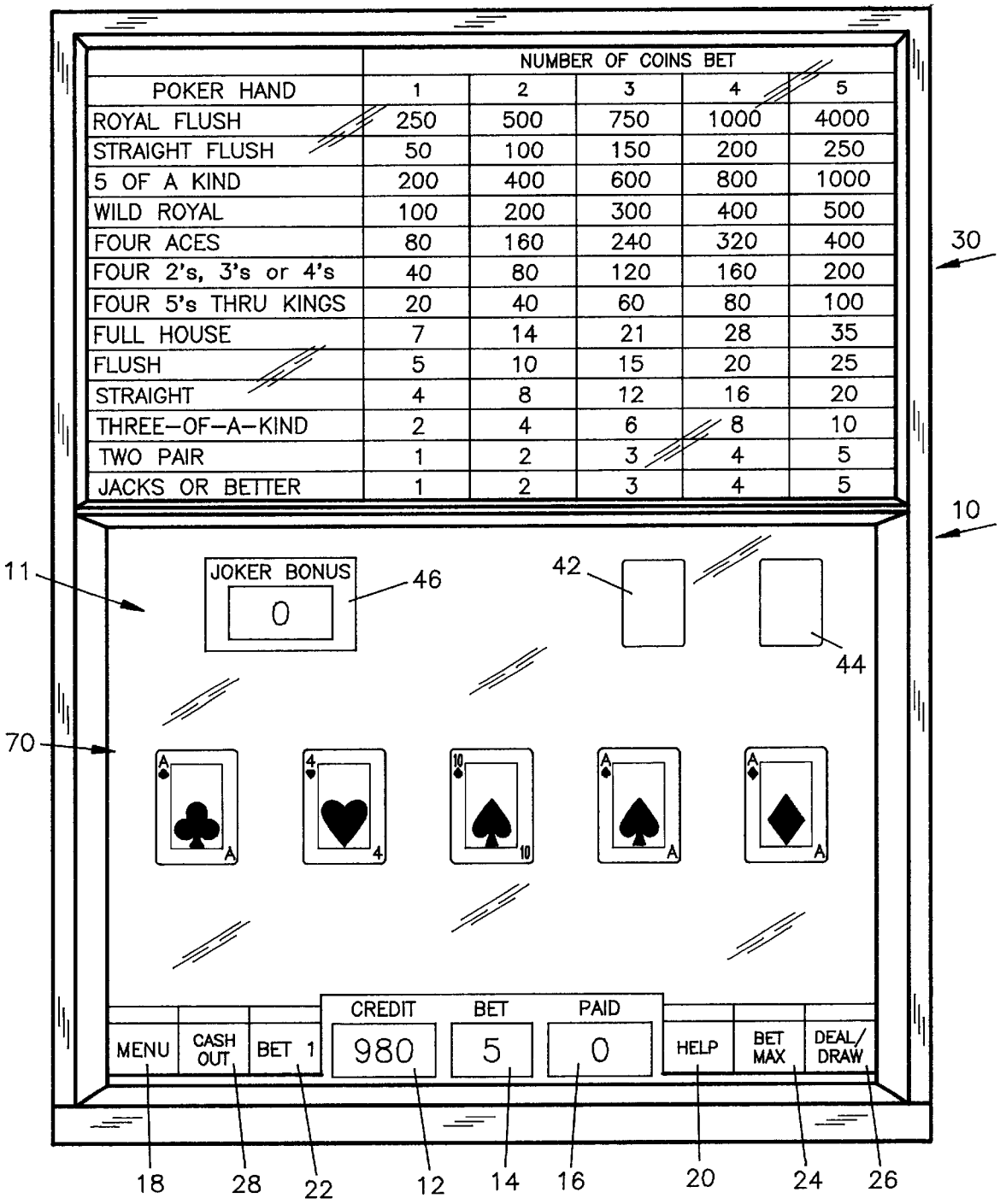
FIG. 2 shows the screen display after the player has selected one of the four hands to play.

After the player has selected one of the hands to play, the three face down cards in the selected hand are turned face up and displayed to the player. In the preferred embodiment of the present invention, the other three non-selected hands will be removed from the screen display and the selected hand will be re-displayed in the center of the screen using larger card displays to make it easier for the player to see the cards. However, it is also within the scope of the present invention to simply leave the non-selected hands on the screen display as inactive hands. FIG. 2 shows by way of example that the player, having selected HAND TWO, has the other three cards revealed and that the player has a five card hand comprising the Ace of Clubs, the Four of Hearts, the Ten of Spades, the Ace of Spades and the Ace of Diamonds.

The player then selects which, if any, of the five cards he wishes to hold. Again this can be accomplished by pressing the appropriate "Hold" buttons as are conventional in electronic video poker gaming machines or by simply pressing the screen display 11 at the location of the cards which the player desires to hold using conventional touch screen technology. (The gaming machine can also be configured to provide "Discard" buttons instead of "Hold" buttons whereby the player presses the "Discard" buttons corresponding to the cards the player wishes to discard or the touch screen can be configured so that the cards that the player touches are discarded instead of held. However, the convention currently in use in the electronic video poker gaming machine industry is to have the player select which cards he wishes to hold, not which cards he wishes to discard).

Figure 3:
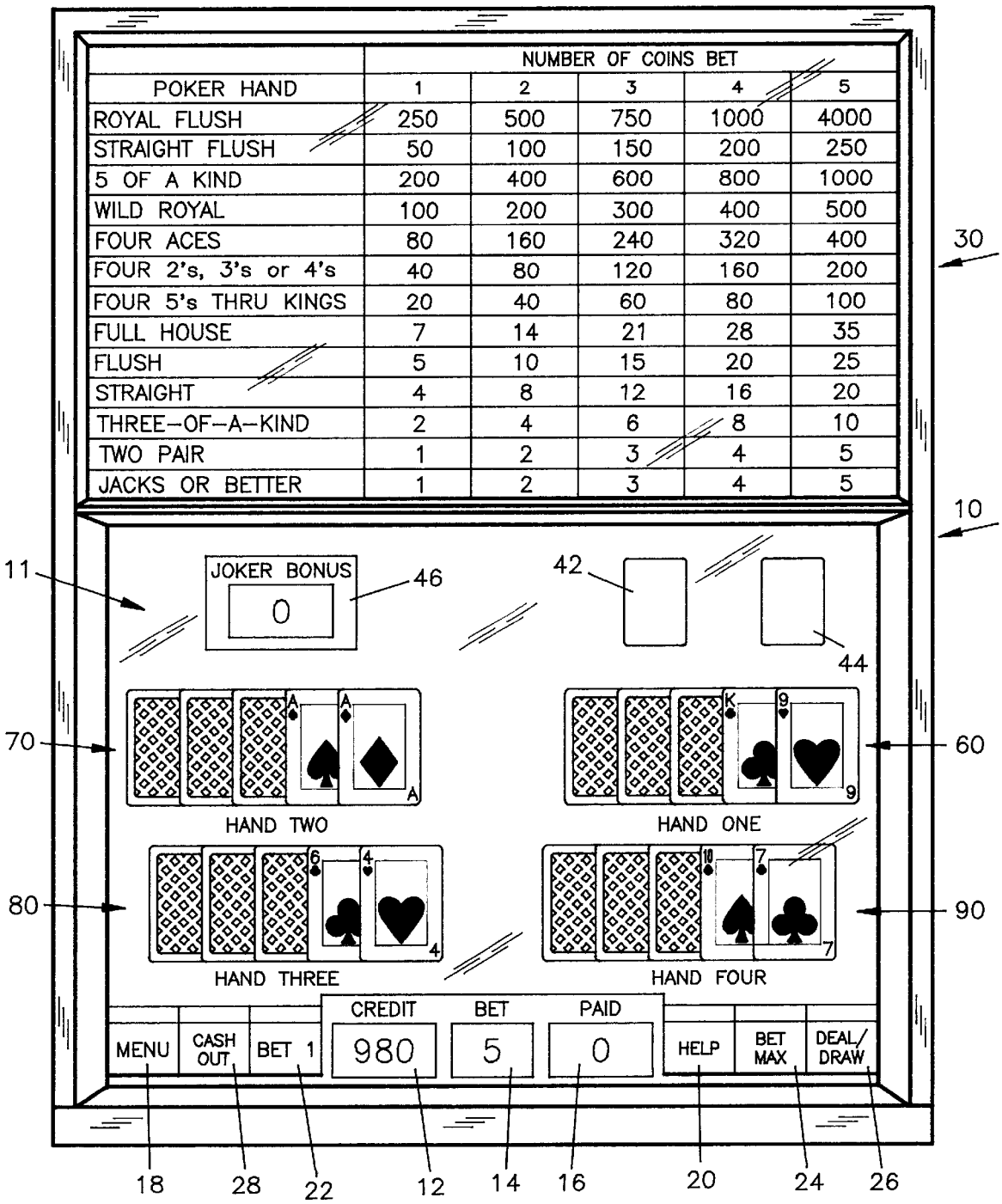
FIG. 3 shows the screen display after the player has selected which cards the player wishes to hold.

Again by way of example, FIG. 3 shows that the player has chosen to hold the Ace of Clubs, the Ace of Spades and the Ace of Diamonds.

The player activates the "Draw" step by pressing the "Deal/Draw" location 26 on the screen display 11 (or by pressing a "Draw" button if buttons are used) to receive replacement cards for the discarded cards, as is conventional in electronic video poker. In this embodiment of the present invention, the replacement cards are dealt using the same fifty-two card deck from which the initial five cards were dealt and that corresponds to the hand selected by the player. For example, if the player has selected HAND TWO to play, the replacement cards are dealt from Deck #2.

Figure 4:
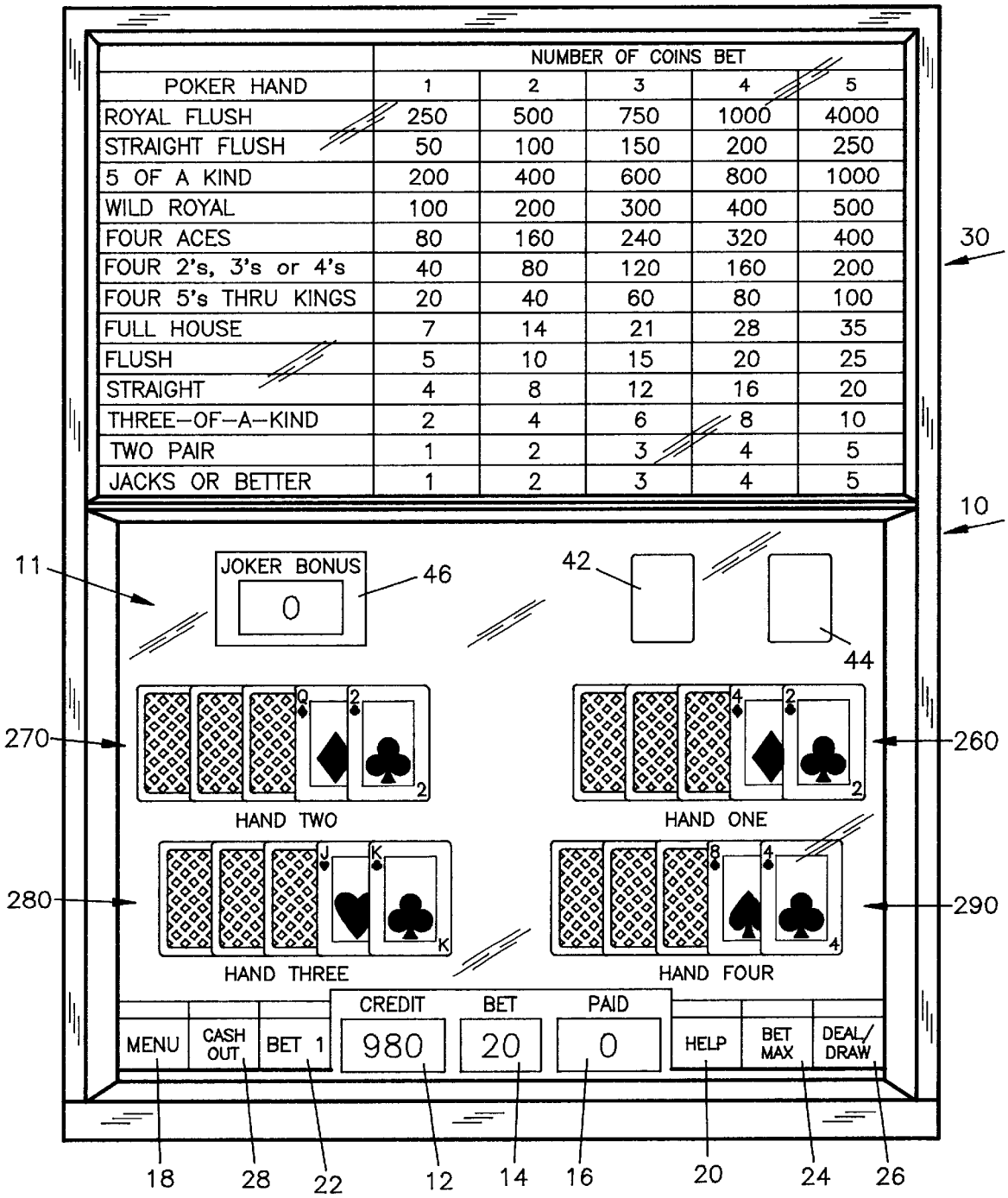
FIG. 4 shows the screen display after the replacement cards have been dealt for the discarded cards.

After the replacement cards are displayed to the player, the resulting five card is used to determine whether the player has a winning or losing hand based on poker hand rankings as shown in the payout table. As shown in FIG. 4, the result of the player's hand after the draw step is that the player has Four Aces and the Eight of Spades.

Just above the screen display 11 is the payout table 30 which shows the winning hand combinations and the amount of the payout to the player based on the number of coins, tokens or credits wagered by the player. In the preferred embodiment of the present invention, a conventional video poker payout table can be used as shown in Table 1.

TABLE 1

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FIVE OF A KIND | 200 | 400 | 600 | 800 | 1000 |
| WILD ROYAL FLUSH | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

Alternatively, other payout tables can be utilized depending on the percentages the house wishes to retain.

With reference to FIG. 4, the player has achieved Four Aces and, if the player has wagered the maximum wager of five credits, the player would be paid 400 credits.

The Bonus Joker feature of the method of play is now determined. During the initial deal of the initial hands of cards or during the deal of replacement cards during the draw step of the method of play, either a "Red" Joker or a "Black" Joker or both may be randomly displayed to the player in a separate location on the screen display 11. Any suitable locations can be provided such as the "Red" Joker location 42 and the "Black" Joker location 44. The computer controls of the present invention can be programmed to display either a "Red" Joker or a "Black" Joker or both Jokers on a random basis during the play of the game. Any suitable frequency of either or both Jokers being displayed can be selected depending on the frequency desired by the gaming establishment that is offering the game.

If the player randomly receives either a "Red" Joker or a "Black" Joker or both during the play of the game, the player then receives a bonus feature in which the Joker becomes a wild card and is substituted seriatim for each card in the final five card hand that corresponds to the color of the Joker received by the player. A poker hand ranking is determined for each instance of substitution of the Joker and the player receives additional payouts in accordance with a pay table. Any suitable pay table can be used such as the pay table that is used with the main game or a separate Joker pay table can be used.

Figure 5:
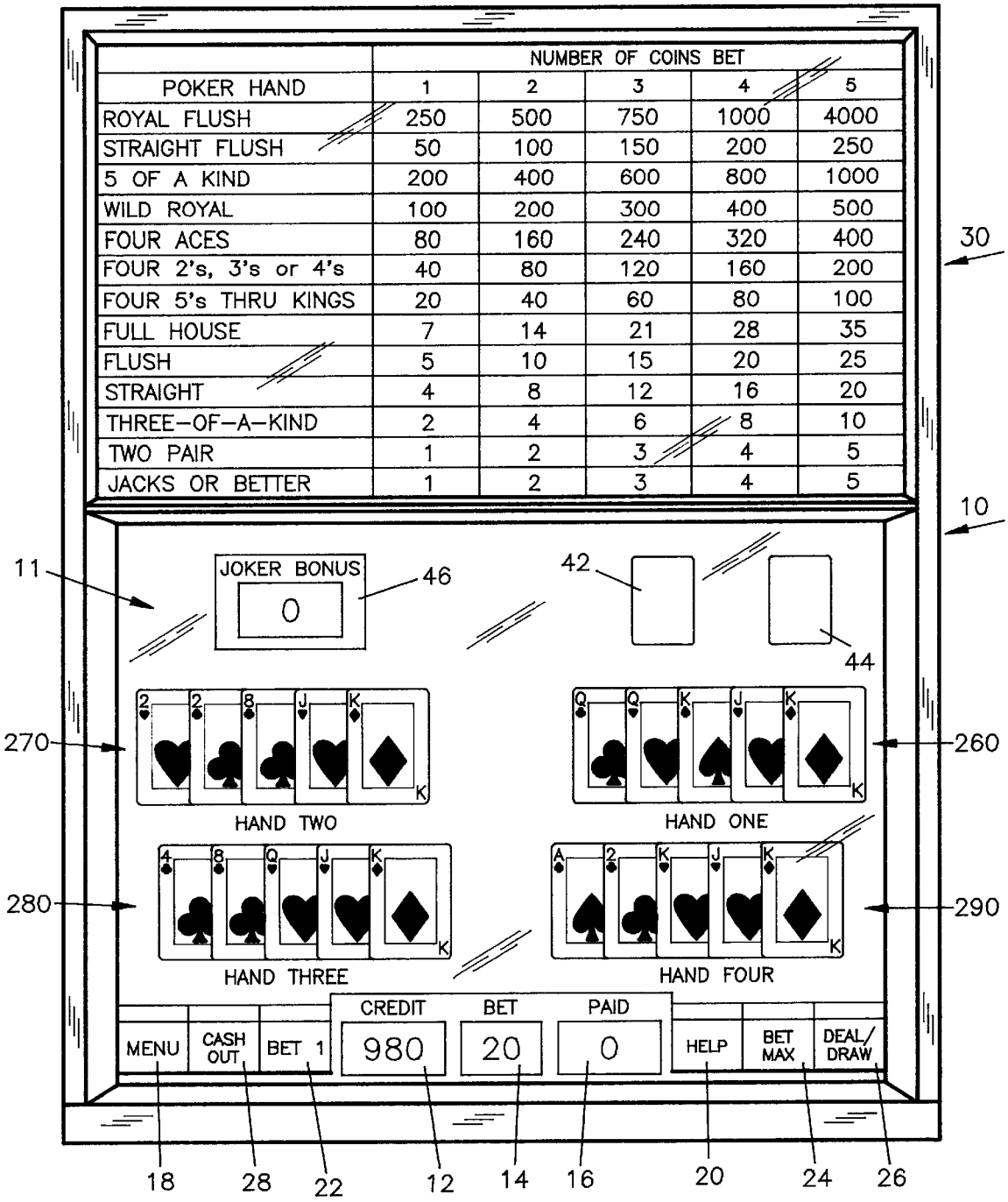
FIG. 5 shows the screen display if the player has received a "Black" Joker and, in accordance with the method of the present invention, this Joker has been substituted for the first black card in the player's hand.

FIG. 5 shows, by way of example, that the player has randomly received the "Black" Joker 44 during the play of the game. The "Black" is substituted, one card location at a time, for each black card in the player's final hand and a poker hand ranking is determined for each instance of substitution. As shown in FIG. 5, the "Black" Joker 44 is first substituted for the Ace of Clubs and the poker hand ranking of Four Aces is achieved. The player is paid 400 credits for this hand in accordance with the pay table shown in Table 1. The credits won by the player for this Bonus Joker feature are shown on the Joker credit meter 26.

Figure 6:
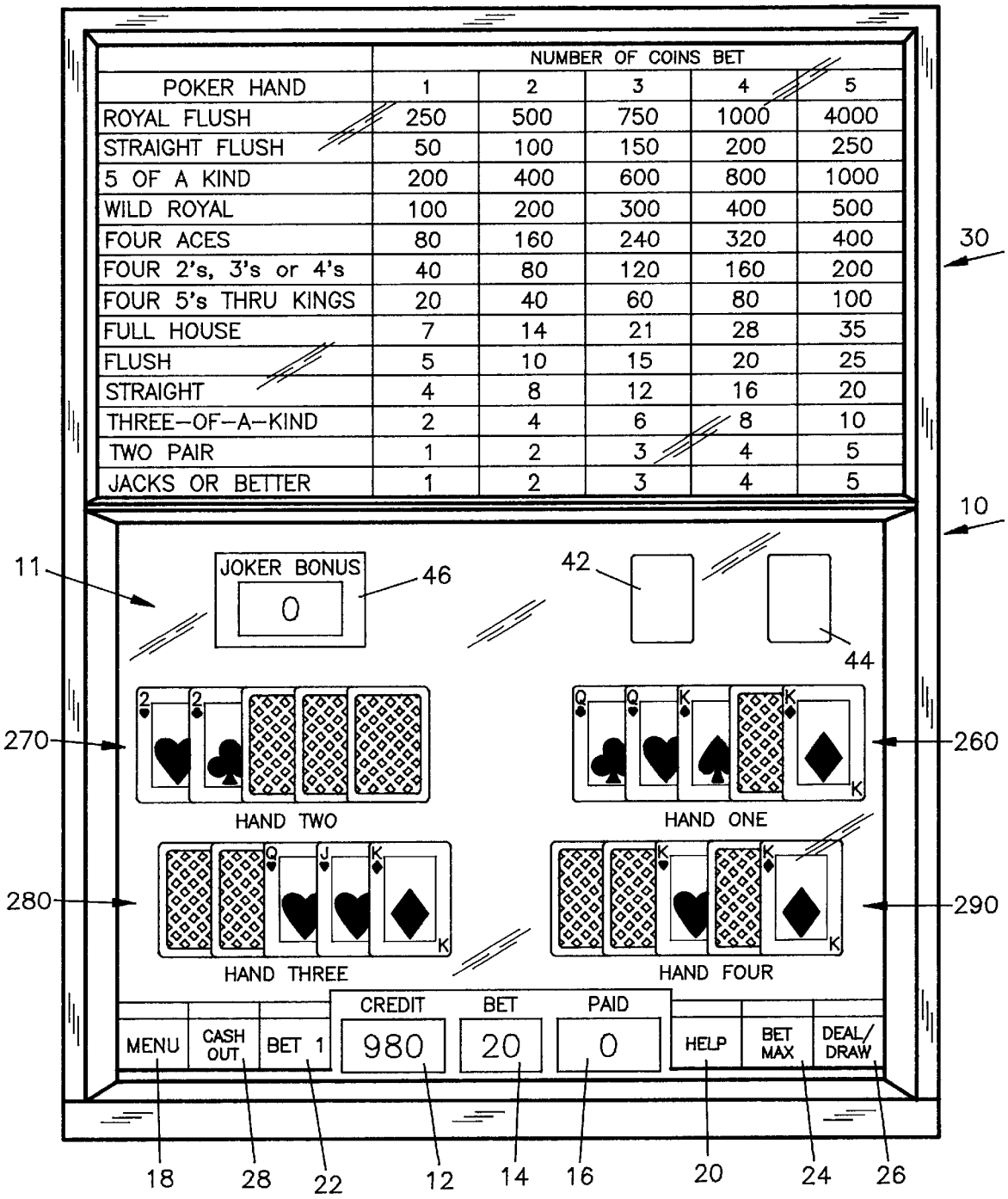
FIG. 6 shows the screen display after the "Black" Joker has been substituted for the second black card in the player's hand.

Next as shown in FIG. 6, the "Black" Joker 44 is substituted for the Eight of Spades and the poker hand ranking of Five of a Kind is achieved. The player is paid 1000 credits for this hand in accordance with the pay table shown in Table 1. The credits won by the player for this Bonus Joker feature are accrued to the previous total on the Joker credit meter 26.

Figure 7:
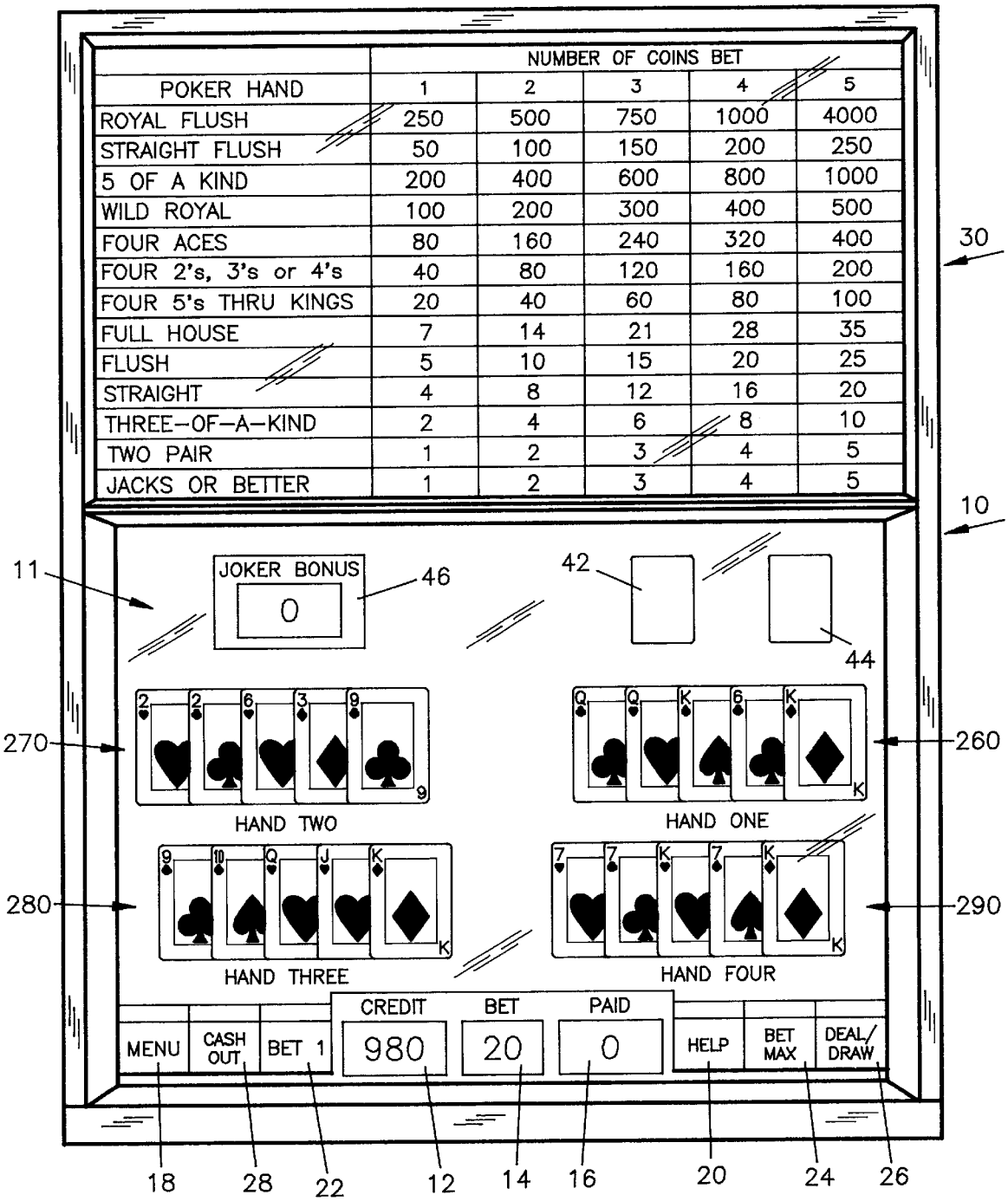
FIG. 7 shows the screen display after the "Black" Joker has been substituted for the third black card in the player's hand.

Finally as shown in FIG. 7, the "Black" Joker 44 is substituted for the Ace of Spades and the poker hand ranking of Four Aces is achieved again. The player is paid 400 credits for this hand in accordance with the pay table shown in Table 1. The credits won by the player for this Bonus Joker feature are also accrued to the previous total on the Joker credit meter 26. When the Bonus Joker feature is completed, the credits shown in the Joker credit meter 26 are transferred to the main credit meter 12.

If the player had randomly received the "Red" Joker instead of the "Black" Joker, the "Red" Joker would only have been substituted, one card location at a time for the two red cards and poker hand rankings would be determined for each instance of substitution of the "Red" Joker. If the player had randomly received both the "Red" Joker and the "Black" Joker, each Joker would be substituted in order for its matching color cards and poker hand rankings would be determined for each instance of substitution.

The game can be applied to any variation of draw poker or stud poker, such as regular Draw Poker, Deuces Wild Poker, Bonus Poker, Double Bonus Poker, Double Double Bonus Poker, Triple Bonus and the like. Each of these video poker variations uses various arrangements of poker hand rankings as winning combinations. Wild cards can be added to the decks so that Joker's Wild or Deuce's Wild can be played. The game can be played in a live game version or an electronic video gaming machine can be programmed to display the game and provide the payouts to the player.

Other modifications of the present invention would include displaying three hands to the player and revealing either two or three cards face up prior to the time the player selects which of the three hands to play. Alternatively, two hands could be displayed to the player with either two or three cards being displayed face up prior to the time the player selects which of the two hands to play.

In accordance with the preferred embodiment of the present invention, when screen displays having four hands initially displayed to the player are used, no more than two cards of each hand should be displayed to the player prior to the player making his selection of which of the four hands he wishes to play. If more than two cards are displayed face up, the play of the game is affected since showing more than two cards face up creates a game that is more favorable to the player than to the house if conventional pay tables are used.

Likewise, for screen displays having two or three hands initially displayed to the player, no more than three cards of each hand should be displayed to the player prior to the player making his selection of which hand to play. In this embodiment, if more than three cards are shown face up, a game that is more favorable to the player than to the house is created if conventional pay tables are used.

Alternatively, the initial hands displayed to the player can be displayed as partial hands without showing the cards that are face down. In this embodiment of the present invention, only the face up cards are shown. For example, HAND ONE would be shown with only two face up cards, HAND TWO would be shown with only two face up cards, HAND THREE would be shown with only two face up cards and HAND FOUR would be shown with only two face up cards. The player would then select one of the partial hands as the hand the player wishes to play. The selected partial hand would then be completed by dealing the remaining three cards face up. The play of the hand would then continue in the manner described above with the player discarding unwanted cards and receiving replacement cards for the discarded cards.

In another alternative embodiment of the present invention in which all of the plurality of hands are dealt from a single deck, after the player selects one of the hands to play, the cards from the non-selected hands are returned to the deck and reshuffled into the deck in order to be available as replacement cards during the draw step.

Figure 8:
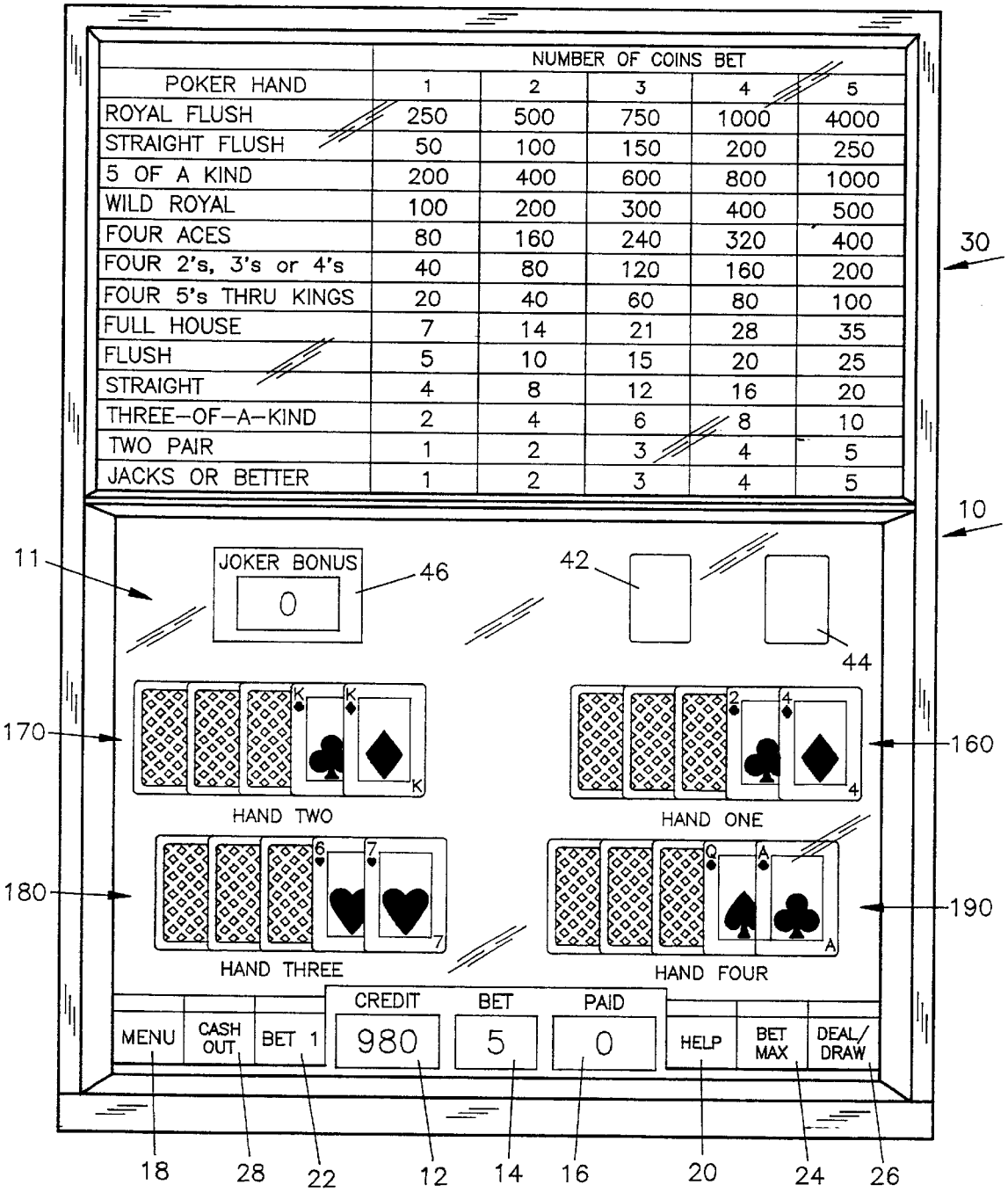
FIG. 8 shows a typical screen display and payout table used in a second embodiment of the method of the present invention, including an example of an initial deal of the cards.

With reference to FIG. 8, an example of an initial deal of four hands for this alternative embodiment of the present invention is shown. HAND ONE 160 has the Two of Clubs, the Four of Diamonds and three face down cards. HAND TWO 170 has the King of Clubs, the King of Diamonds and three face down cards. HAND THREE 180 has the Six of Hearts, the Seven of Hearts and three face down cards. HAND FOUR 190 has the Queen of Spades, the Ace of Clubs and three face down cards. While the player may select any of the four hands as the hand to play, the player in this example would most likely select HAND TWO 170 since this hand a pair of Kings.

After the player has selected one of the hands to play, the non-selected hands are removed from the video screen 11 and the cards of those hands are returned to the deck and reshuffled with the other cards in the deck. The three face down cards in the selected hand are turned face up and displayed to the player. For example, with reference again to FIG. 8, if the player selects to play HAND TWO, all of the cards from HAND ONE, HAND THREE and HAND FOUR are returned to deck and are reshuffled into the deck so as to be available as replacement cards during the draw step.

Figure 9:
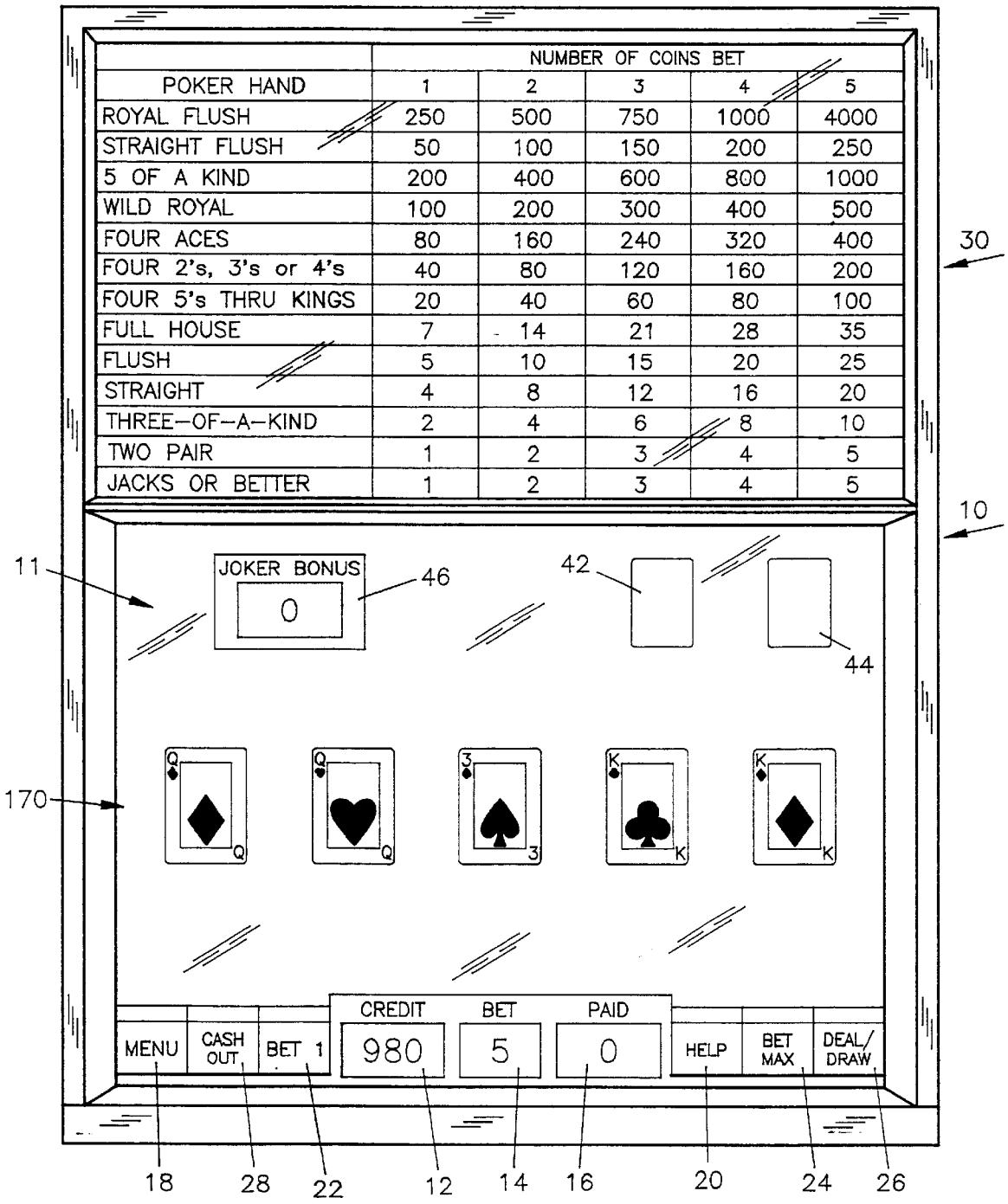
FIG. 9 shows the screen display after the player has selected one of the four hands to play.

FIG. 9 shows by way of example that the player, having selected HAND TWO, has the other three cards revealed and that the player has a five card hand comprising the Queen of Diamonds, the Queen of Hearts, the Three of Spades, the King of Clubs and the King of Diamonds.

Figure 10:
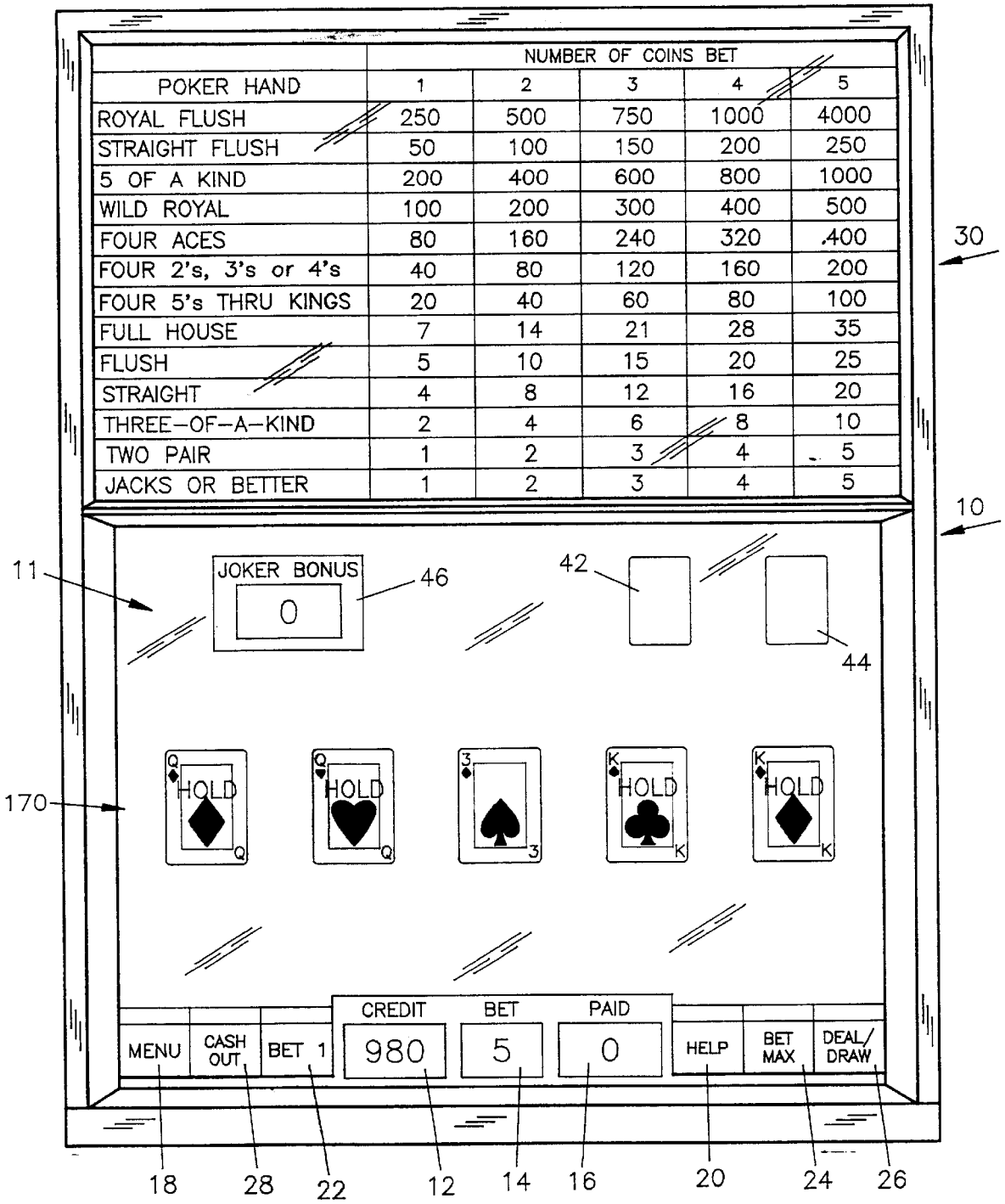
FIG. 10 shows the screen display after the player has selected which cards the player wishes to hold.

The player then selects which, if any, of the five cards he wishes to hold. Again by way of example, FIG. 10 shows that the player has chosen to hold the Queen of Diamonds, the Queen of Hearts, the King of Clubs and the King of Diamonds.

The player activates the "Draw" step to receive replacement cards for the discarded cards. In this embodiment of the present invention, the replacement cards are dealt using the original, single fifty-two card deck from which the initial five cards were dealt having the discarded cards from the other three hands shuffled back in.

Figure 11:
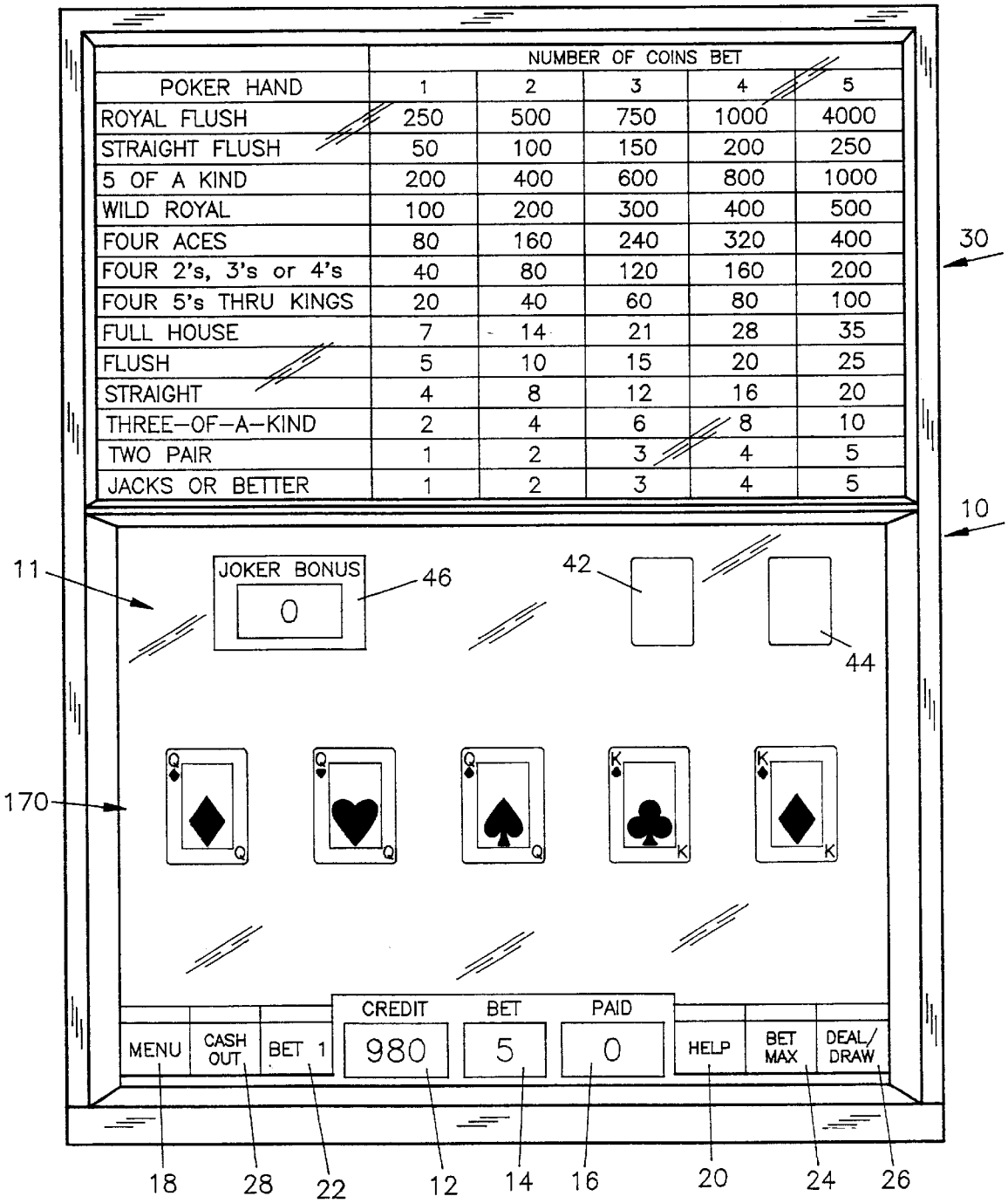
FIG. 11 shows the screen display after the replacement cards have been dealt for the discarded cards.

After the replacement cards are displayed to the player, the resulting five card is used to determine whether the player has a winning or losing hand based on poker hand rankings as shown in the payout table. As shown in FIG. 11, the result of the player's hand after the draw step is that the player has a Full House with three Queens and two Kings.

Just above the screen display 11 is the payout table 30 which shows the winning hand combinations and the amount of the payout to the player based on the number of coins, tokens or credits wagered by the player. In the preferred embodiment of the present invention, a conventional video poker payout table can be used as shown in Table 2.

TABLE 2

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FIVE OF A KIND | 200 | 400 | 600 | 800 | 1000 |
| WILD ROYAL FLUSH | 100 | 200 | 300 | 400 | 500 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

Alternatively, other payout tables can be utilized depending on the percentages the house wishes to retain.

With reference to FIG. 11, the player has achieved a Full House and, if the player has wagered the maximum wager of five credits, the player would be paid 35 credits.

The Bonus Joker feature of the method of play is now determined. During the initial deal of the initial hands of cards or during the deal of replacement cards during the draw step of the method of play, either a "Red" Joker or a "Black" Joker or both may be randomly displayed to the player in a separate location on the screen display 11. Any suitable locations can be provided such as the "Red" Joker location 42 and the "Black" Joker location 44. The computer controls of the present invention can be programmed to display either a "Red" Joker or a "Black" Joker or both Jokers on a random basis during the play of the game. Any suitable frequency of either or both Jokers being displayed can be selected depending on the frequency desired by the gaming establishment that is offering the game.

If the player randomly receives either a "Red" Joker or a "Black" Joker or both during the play of the game, the player then receives a bonus feature in which the Joker becomes a wild card and is substituted seriatim for each card in the final five card hand that corresponds to the color of the Joker received by the player. A poker hand ranking is determined for each instance of substitution of the Joker and the player receives additional payouts in accordance with a pay table. Any suitable pay table can be used such as the pay table that is used with the main game or a separate Joker pay table can be used.

Figure 12:
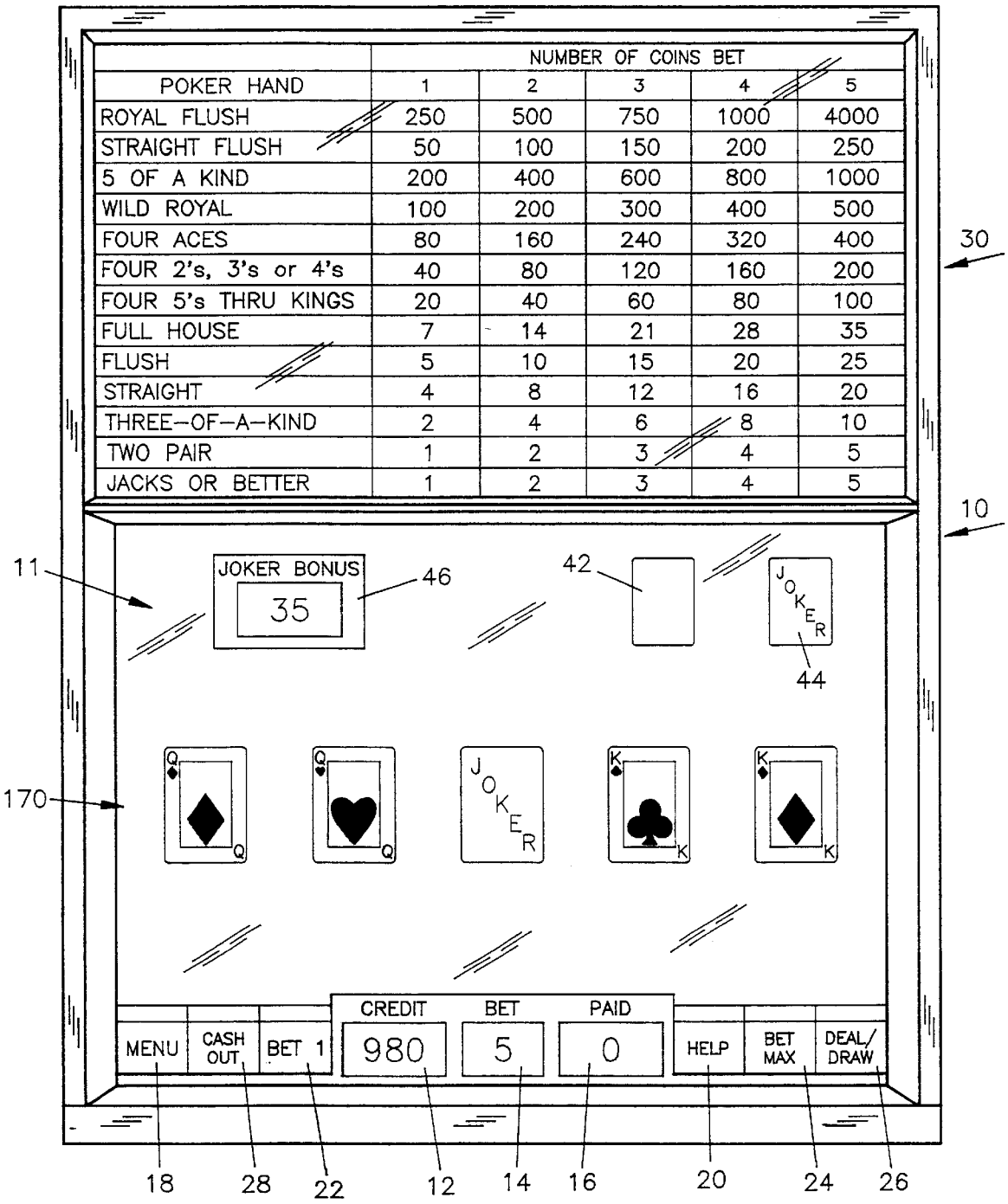
FIG. 12 shows the screen display if the player has received a "Black" Joker and, in accordance with the method of the present invention, this Joker has been substituted for the first black card in the player's hand.

FIG. 12 shows, by way of example, that the player has randomly received the "Black" Joker 44 during the play of the game. The "Black" Joker 44 is substituted, one card location at a time, for each black card in the player's final hand and a poker hand ranking is determined for each instance of substitution. As shown in FIG. 12, the "Black" Joker 44 is first substituted for the Queen of Spades and the poker hand ranking of a Full House is achieved. The player is paid 35 credits for this hand in accordance with the pay table shown in Table 2. The credits won by the player for this Bonus Joker feature are shown on the Joker credit meter 26.

Figure 13:
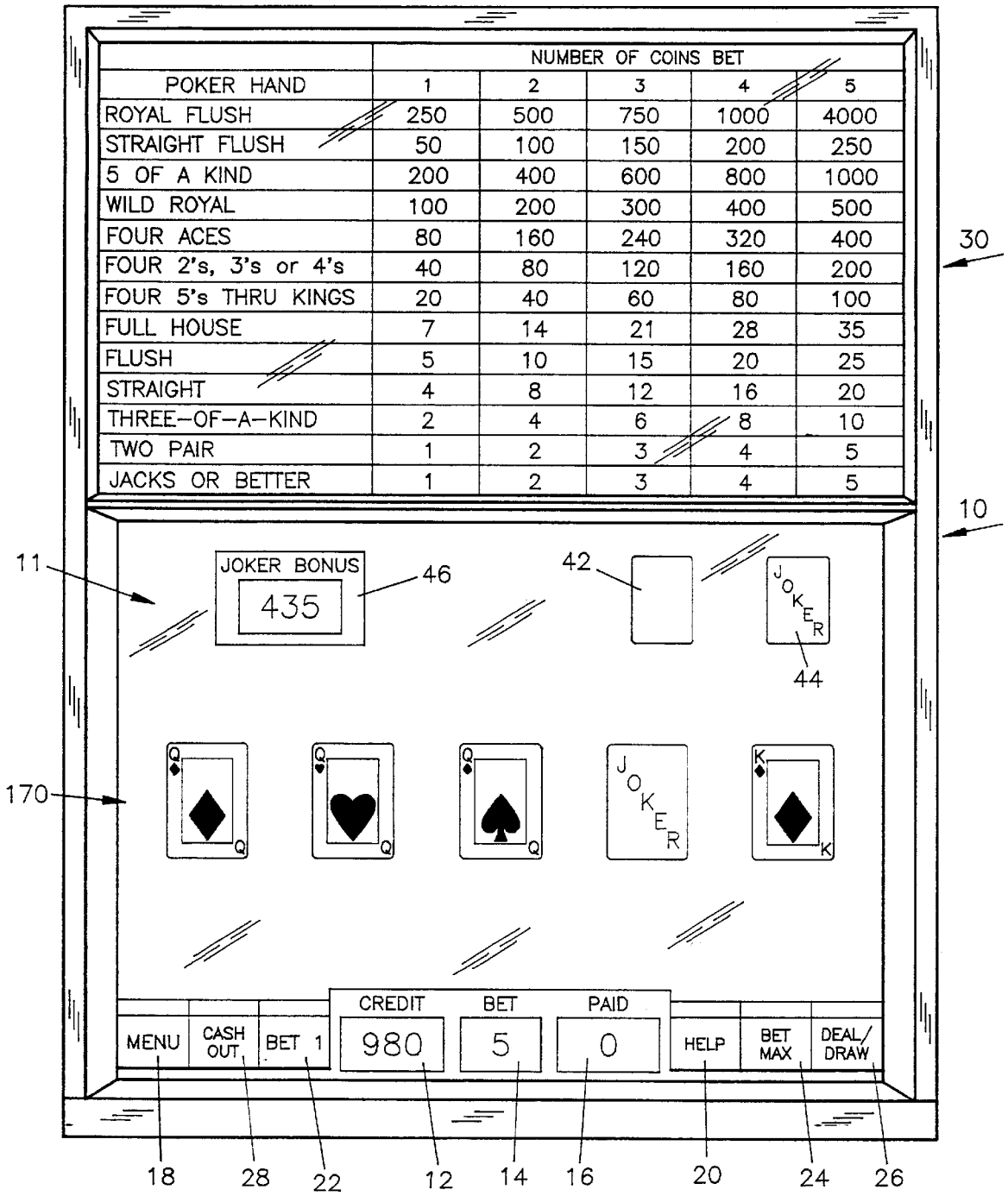
FIG. 13 shows the screen display after the "Black" Joker has been substituted for the second black card in the player's hand.

Finally, as shown in FIG. 13, the "Black" Joker 44 is substituted for the King of Clubs and the poker hand ranking of Four of a Kind is achieved. The player is paid 400 credits for this hand in accordance with the pay table shown in Table 2. The credits won by the player for this Bonus Joker feature are accrued to the previous total on the Joker credit meter 26.

If the player had randomly received the "Red" Joker instead of the "Black" Joker, the "Red" Joker would only have been substituted, one card location at a time for the three red cards and poker hand rankings would be determined for each instance of substitution of the "Red" Joker. If the player had randomly received both the "Red" Joker and the "Black" Joker, each Joker would be substituted in order for its matching color cards and poker hand rankings would be determined for each instance of substitution.

Another variation of the method of play of the present invention, which is to be called Pick 144 Poker, involves duplicating cards from the initial hand selected by the player into the other three hands and then applying to each of the final hands any Jokers that the player may have achieved during the play of the game. The method of play of this variation is shown in FIGS. 14–27.

In order to participate in a round of pick 144 Poker, a player makes a wager. In the preferred embodiment of this variation, the player would make a wager to be allocated to each of the four hands that will be dealt to the player. The player would use coins or tokens inserted into a coin head on the gaming machine, or insert paper currency into a bill acceptor on the gaming machine or use previously accrued credits to make his wager. As is conventional in electronic video draw poker machines, the player would wager between one and five credits for each hand, although the maximum number of credits per hand could be any amount. Assuming that five credits was the maximum wager on each hand, the player would wager twenty credits to make the maximum bet to play all four hands. In the preferred embodiment of this variation, the player would be required to play all four hands, although the gaming machine could be configured to allow the player to play either one, two, three or all four hands if the player so desired.

Figure 14:
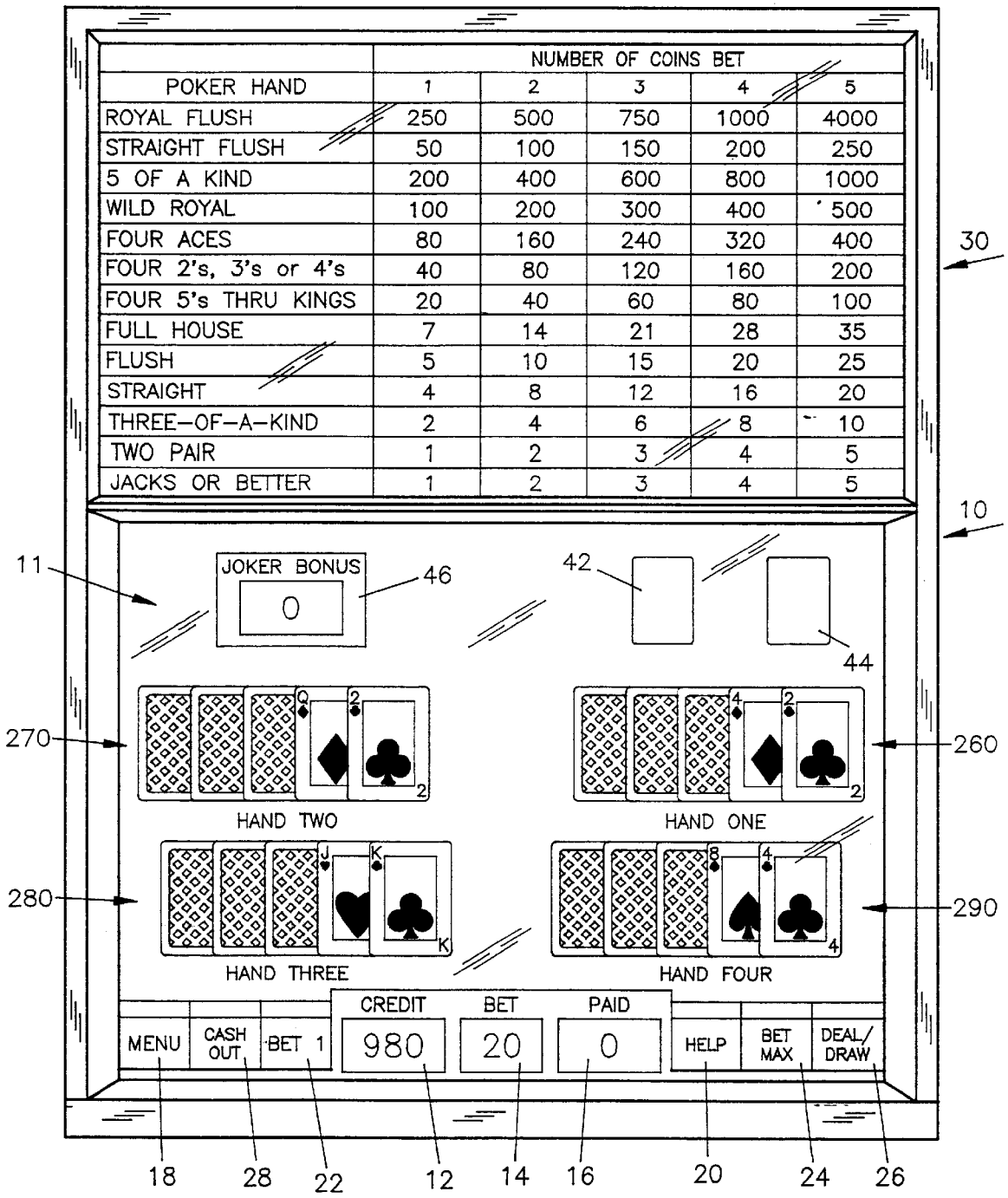
FIG. 14 shows a typical screen display and payout table of a third embodiment of the present invention which duplicates the initial hand selected by the player into the other hand positions.

With regard to the example shown in FIG. 14, the player has made the maximum wager of five credits on each of the four hands so the player has made a total wager of twenty credits. The computer controls of the gaming machine, after completing a shuffling of the cards, has displayed the initial four hands to the player. Each hand is dealt with five cards. In the preferred embodiment of this variation, each hand has two cards face up and three cards face down, although more or less than two cards can be dealt face up. Again, in the preferred embodiment of this variation, each hand is dealt from its own distinct deck of playing cards, although it is also possible to practice this variation by dealing all four hands from a single deck of playing cards.

With reference to the example shown in FIG. 14, Hand One 260 has received three cards face down and two cards face up: the Four of Diamonds and the Two of Clubs; Hand Two 270 has received three cards face down and two cards face up: the Queen of Diamonds and the Two of Clubs; Hand Three 280 has received three cards face down and two cards face up: the Jack of Hearts and the King of Clubs; and Hand Four 290 has received three cards face down and two cards face up: the Eight of Spades and the Four of Clubs.

Figure 15:
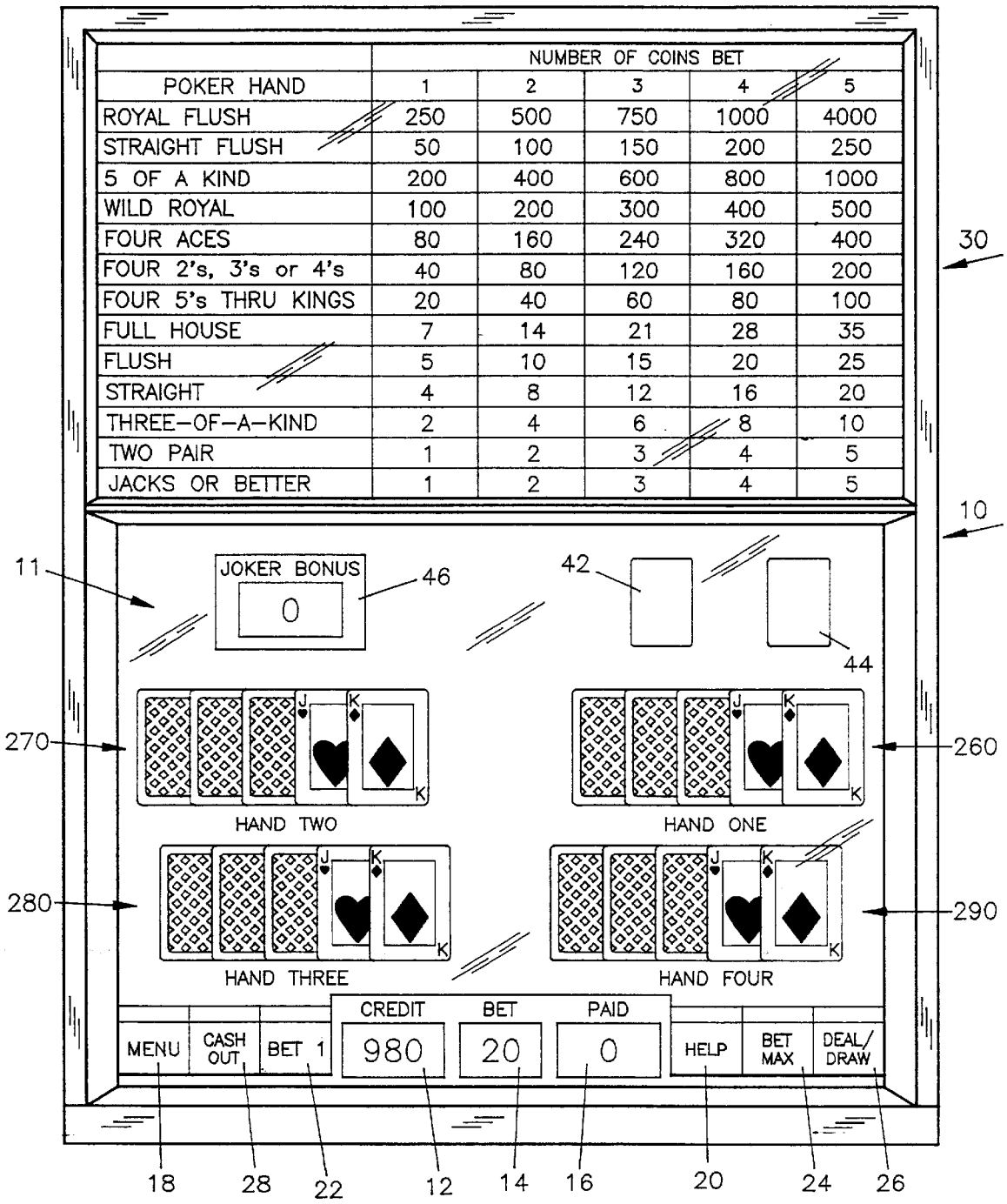
FIG. 15 shows a screen display of this third embodiment of the present invention after the player has selected one of the initial hands and that hand has been duplicated into the other hand positions.

The player now selects one of the sets of the two face up cards as the face up cards that the player wishes to play and the two face up cards so selected are duplicated into the other four hands as replacement cards for the two face up cards initially dealt in each hand. As shown in FIG. 15, the player has selected the two face up cards from initial Hand Three 280 and these two face up cards—the Jack of Hearts and the King of Diamonds have been duplicated into the other three hands as replacement cards for the two face up cards initially dealt in these hands.

The three remaining face down cards in each of the four hands are now revealed and the player is shown all five cards in each of the four hands.

Figure 16:
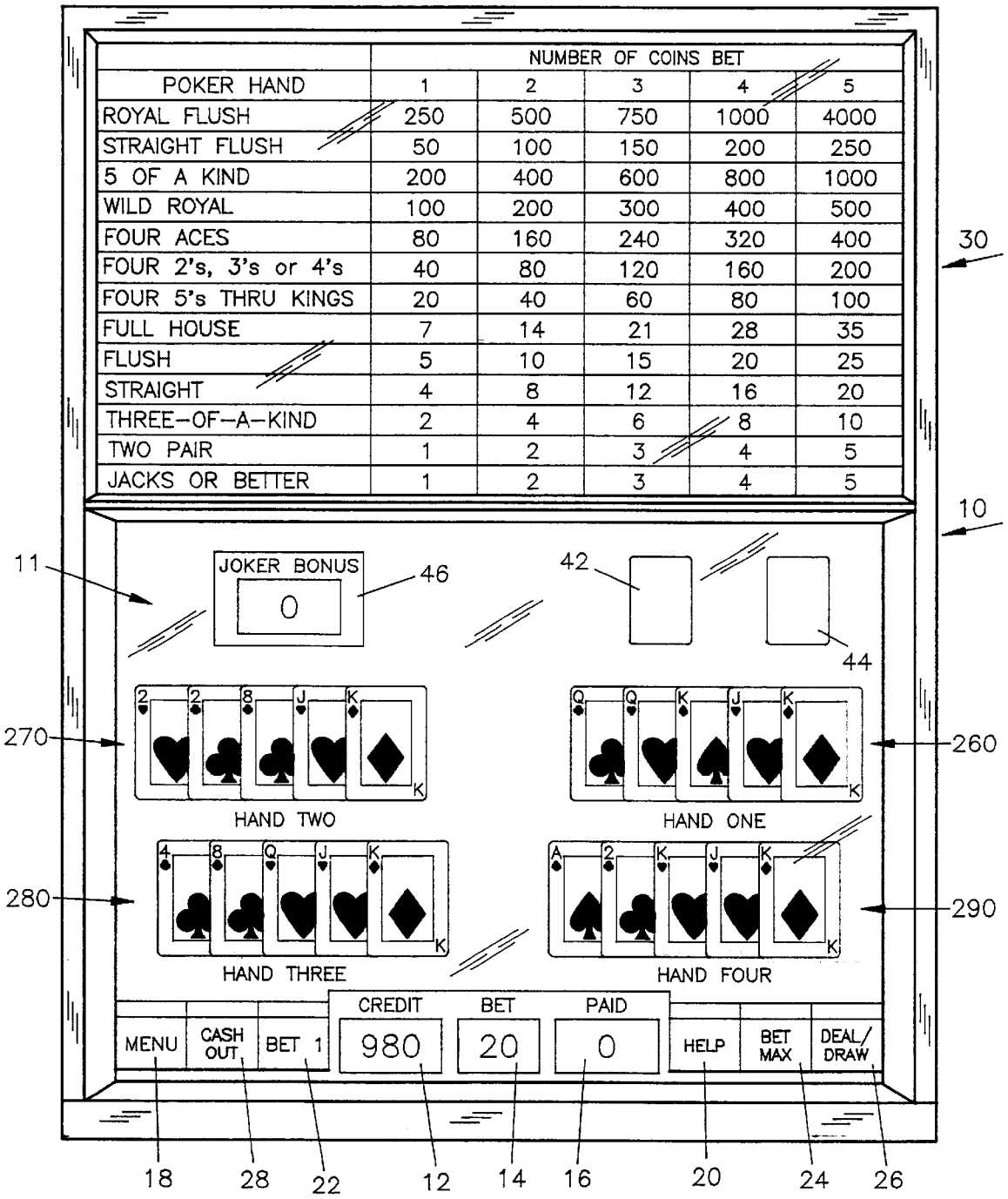
FIG. 16 shows the screen display after all five cards have been revealed in the four hand positions.

As shown in the example in FIG. 16, the player now has four hands to play. Hand One 260 now contains the Queen of Clubs, the Queen of Hearts, the King of Spades, the Jack of Hearts and the King of Diamonds. Hand Two 270 now contains the Two of Hearts, the Two of Clubs, the Eight of Clubs, the Jack of Hearts and the King of Diamonds. Hand Three 280 now contains the Four of Clubs, the Eight of Clubs, the Queen of Hearts, the Jack of Hearts and the King of Diamonds. Hand Four 290 now contains the Ace of Spades, the Two of Clubs, the King of Hearts, the Jack of Hearts and the King of Diamonds.

The player is now provided with the opportunity to hold any cards and discard any other cards from each of the four hands as would be conventional in draw poker. Each hand is played individually.

Figure 17:
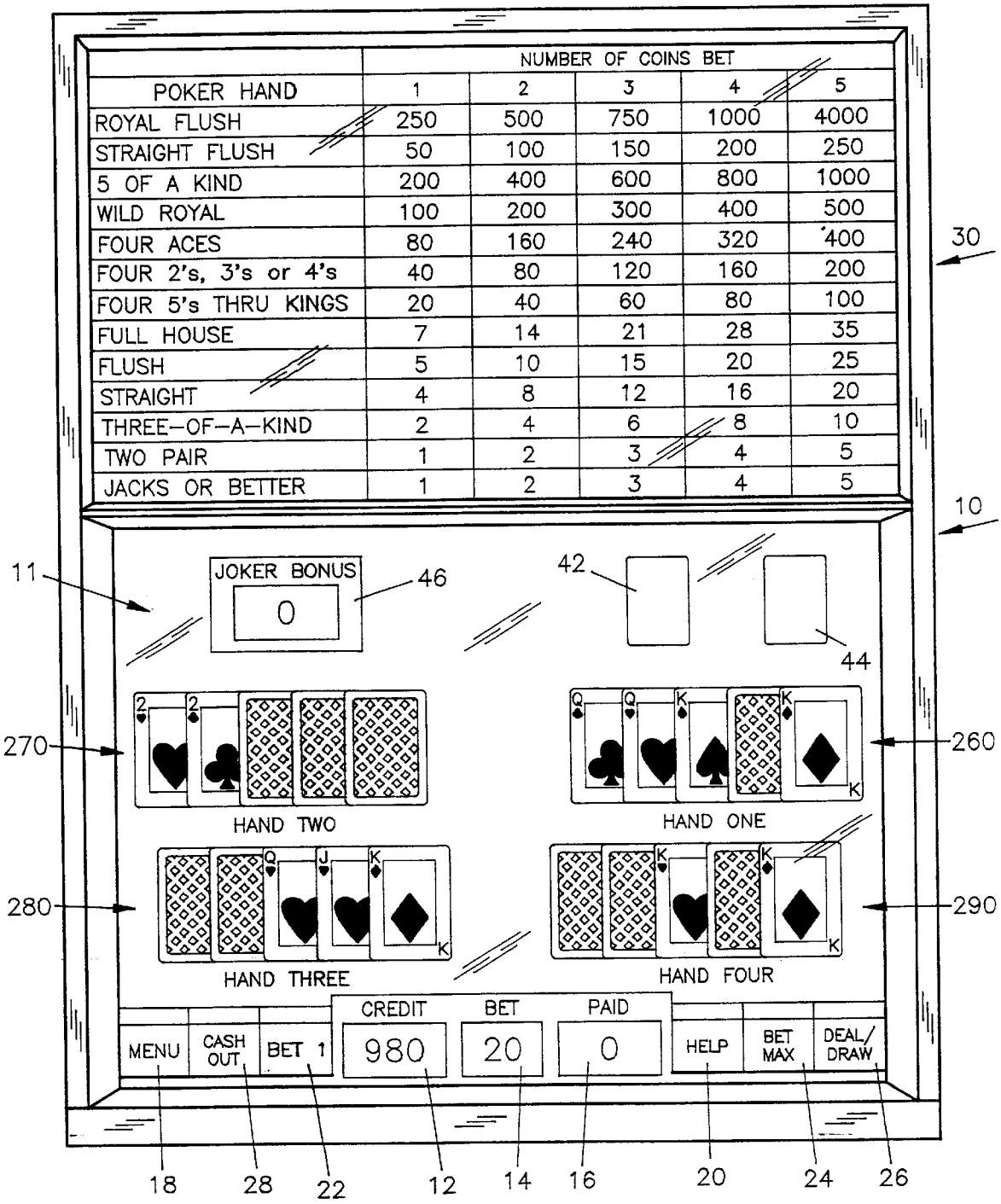
FIG. 17 shows the screen display after the player has selected which cards to hold in each of the four hand positions.

FIG. 17 show for example, that the player has held in Hand One 260: the Queen of Clubs, the Queen of Hearts, the King of Spades and the King of Diamonds and discarded the Jack of hearts. In Hand Two 270 the player has held the Two of Hearts and the Two of Clubs and discarded the Eight of Clubs, the Jack of Hearts and the King of Diamonds. In Hand Three 280, the player has held the Queen of Hearts, the Jack of Hearts and the King of Diamonds and discarded the Four of Clubs and the Eight of Clubs. Finally in Hand Four 290, the player has held the King of Hearts and the King of Diamonds and discarded the Ace of Spades, the Two of Clubs and the Jack of Hearts. Replacement cards for the discarded cards are dealt to each hand.

After the replacement cards have been dealt, each replacement card is turned face up to reveal the final five card hand of each of the four hands. The final five card hand in each of the four hands is analyzed to determine its poker hand ranking and compared to a pay table to determine if the hand is a winning or losing hand. Winning hands are paid based on the poker hand ranking and the number of coins, tokens or credits wagered by the player on that hand.

Figure 18:
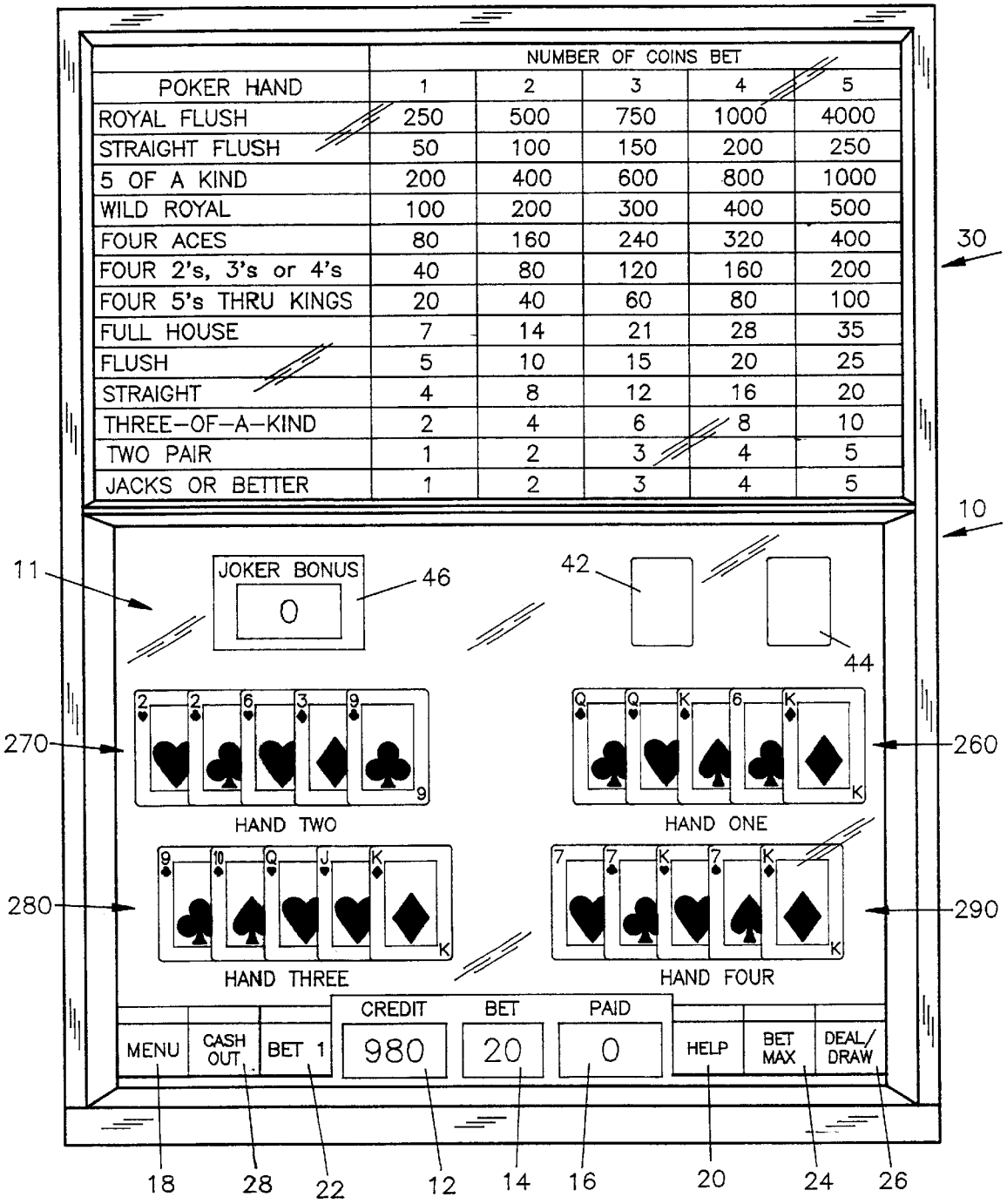
FIG. 18 shows the screen display after replacement cards have been dealt for the discarded cards in each of the four hand positions.

For example, FIG. 18 shows the final five card hand of each of the four hands after the replacement cards have been revealed. In Hand One 260, the player has achieved Two Pair (Queens and Kings) and would be paid 10 credits for a wager of 5 credits as shown in Table 1. In Hand Two 270, the player has a single Pair of Deuces and this is a losing hand. In Hand Three 280 the player has achieved a Straight (King through Nine) and would be paid 20 credits for a wager of 5 credits as shown in Table 1. Finally in Hand Four 290, the player has achieved a Full House (Sevens full of Kings) and would be paid 35 credits for a wager of 5 credits as shown in Table 1.

Variations may be made to this alternative embodiment of the present invention. Instead of dealing all five cards initially to each of the four hands, the initial deal may be dealt with only the face up cards. For example, with regard to the FIG. 14, the initial deal may only show the two face up cards in each of the four hands. The player would then select one of the two card hands to be duplicated into the other three hands and then the deal is completed by adding three more cards to each hand.

The Bonus Joker feature of the method of play is now determined in connection with this Pick 11 variation of the present invention. During the initial deal of the initial hands of cards or during the deal of replacement cards during the draw step of the method of play, either a "Red" Joker or a "Black" Joker or both may be randomly displayed to the player in a separate location on the screen display 11. Any suitable locations can be provided such as the "Red" Joker location 42 and the "Black" Joker location 44. The computer controls of the present invention can be programmed to display either a "Red" Joker or a "Black" Joker or both Jokers on a random basis during the play of the game. Any suitable frequency of either or both Jokers being displayed can be selected depending on the frequency desired by the gaming establishment that is offering the game.

If the player randomly receives either a "Red" Joker or a "Black" Joker or both during the play of the game, the player then receives a bonus feature in which the Joker becomes a wild card and is substituted seriatim for each card in each of the final five card hands that corresponds to the color of the Joker received by the player. A poker hand ranking is determined for each instance of substitution of the Joker and the player receives additional payouts in accordance with a pay table. Any suitable pay table can be used such as the pay table that is used with the main game or a separate Joker pay table can be used.

Figure 19:
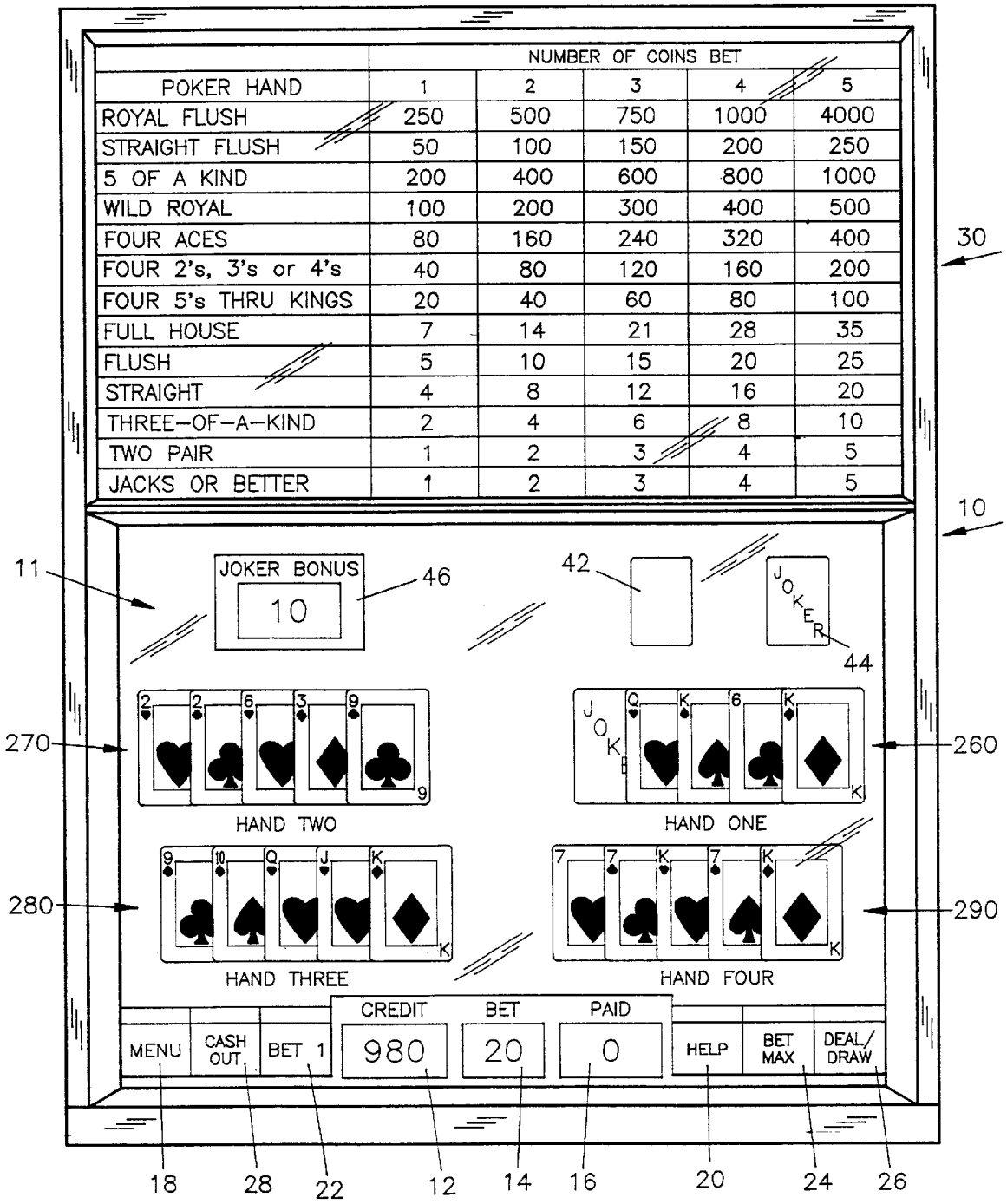
FIG. 19 shows the screen display if the player has received a "Black" Joker and, in accordance with the method of the present invention, this Joker has been substituted for the first black card in the player's Hand One.

FIG. 19 shows, by way of example, that the player has randomly received the "Black" Joker 44 during the play of the game. The "Black" Joker 44 is substituted, one card location at a time, for each black card in each of the player's final hands and a poker hand ranking is determined for each instance of substitution. As shown in FIG. 19, the "Black" Joker 44 is first substituted for the Queen of Clubs in Hand One 260 and the poker hand ranking of Three of a Kind is achieved. The player is paid 10 credits for this hand in accordance with the pay table shown in Table 1. The credits won by the player for this Bonus Joker feature are shown on the Joker credit meter 46.

Figure 20:
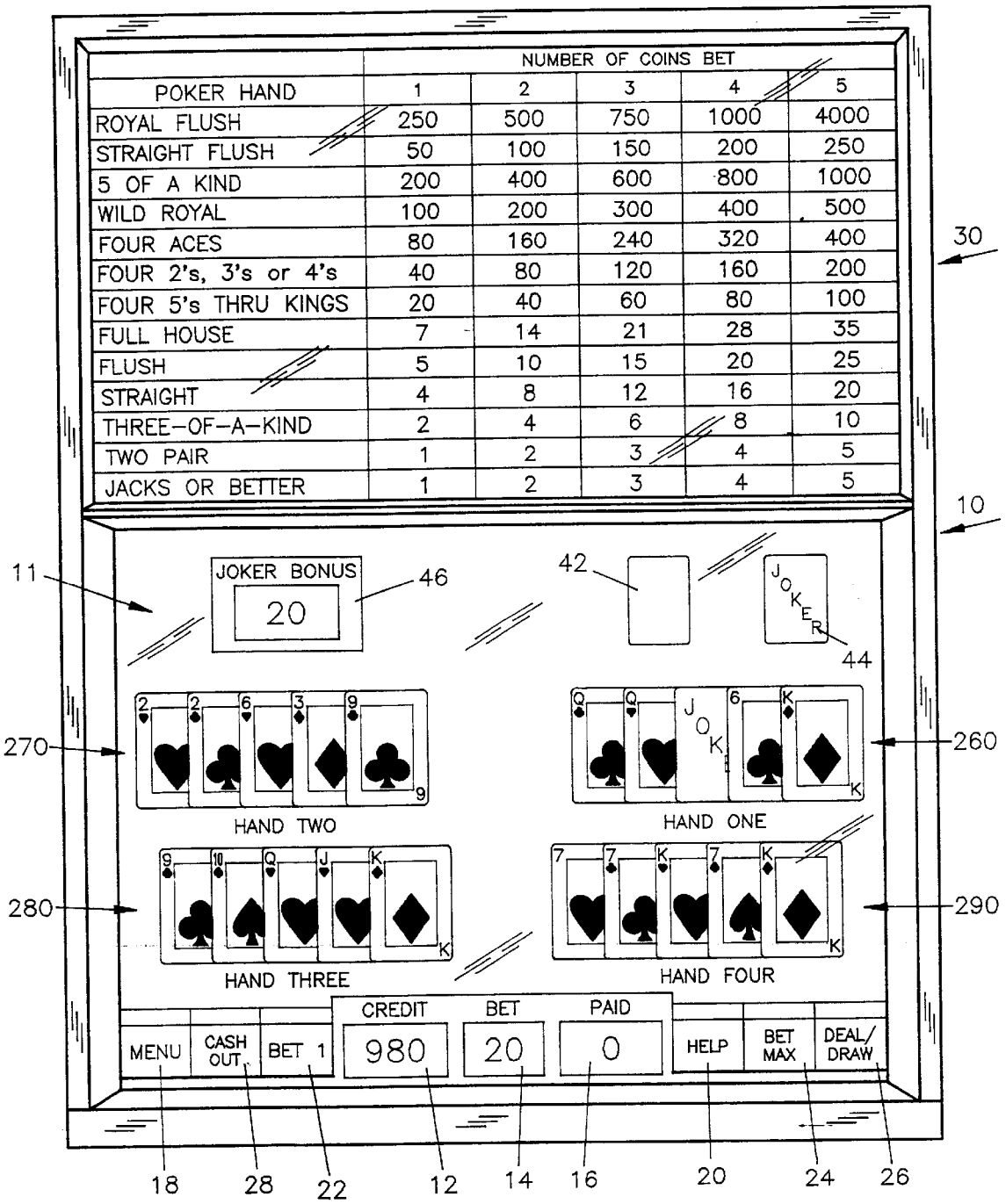
FIG. 20 shows the screen display after the "Black" Joker has been substituted for the second black card in the player's Hand One.

Then, as shown in FIG. 20, the "Black" Joker 44 is substituted for the King of Spades in Hand One 260 and the poker hand ranking of Three of a Kind is achieved. The player is paid another 10 credits for this hand in accordance with the pay table shown in Table 1. The credits won by the player for this Bonus Joker feature are accrued to the previous total on the Joker credit meter 46.

Figure 21:
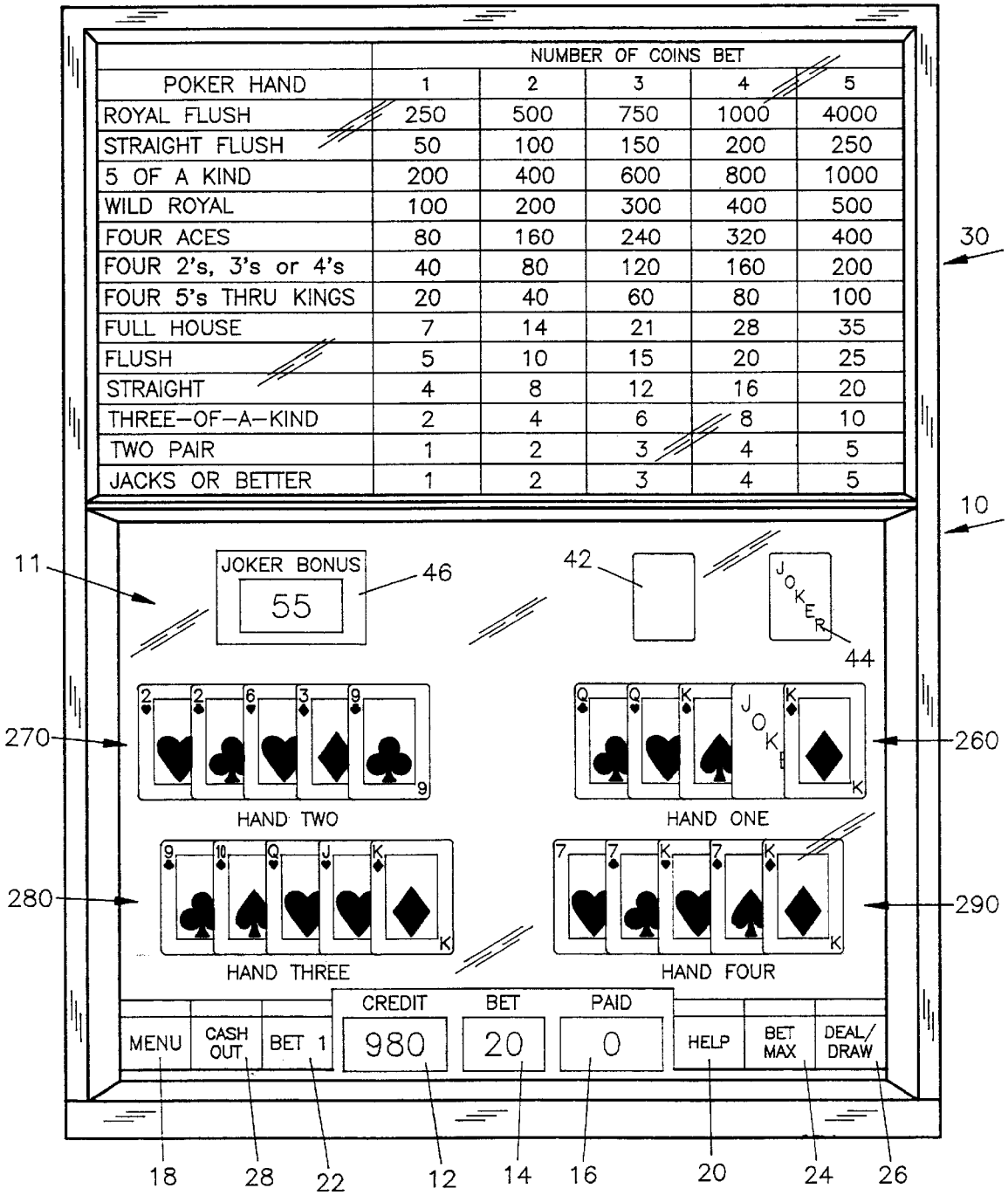
FIG. 21 shows the screen display after the "Black" Joker has been substituted for the third black card in the player's Hand One.

Next, as shown in FIG. 21, the "Black" Joker 44 is substituted for the Six of Clubs in Hand One 260 and the poker hand ranking of a Full House is achieved. The player is paid 35 credits for this hand in accordance with the pay table shown in Table 1. The credits won by the player for this Bonus Joker feature are accrued to the previous total on the Joker credit meter 46.

Figure 22:
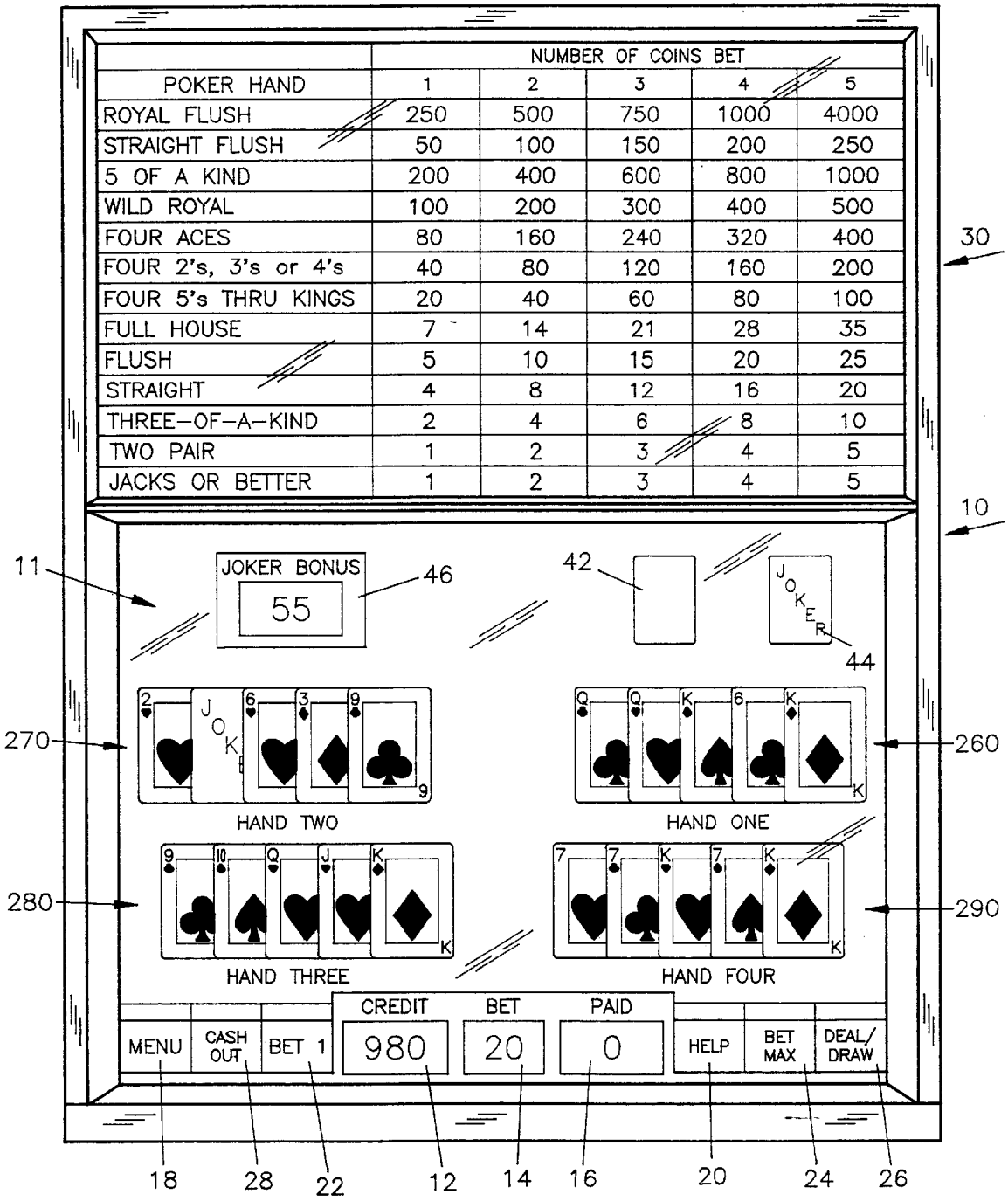
FIG. 22 shows the screen display after the "Black" Joker has been substituted for the first black card in the player's Hand Two.

This substitution of the Joker now proceeds to Hand Two 270. As shown in FIG. 22, the "Black" Joker 44 is first substituted for the Two of Clubs in Hand Two 270 and the poker hand ranking of a Pair of Nines is achieved. The player is paid zero credits for this hand in accordance with the pay table shown in Table 1.

Figure 23:
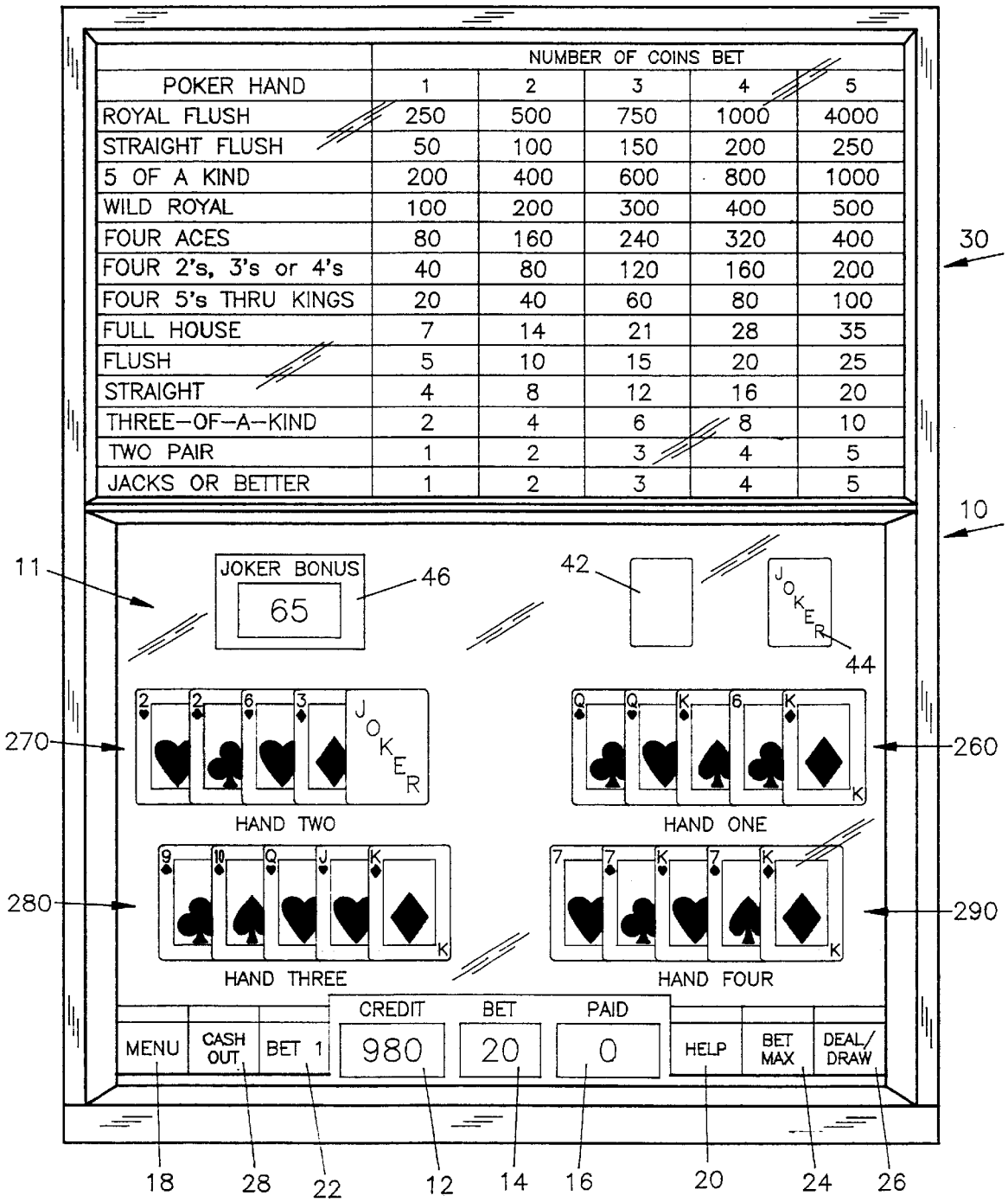
FIG. 23 shows the screen display after the "Black" Joker has been substituted for the second black card in the player's Hand Two.

Then, as shown in FIG. 23, the "Black" Joker 44 is substituted for the Nine of Clubs in Hand Two 270 and the poker hand ranking of Three of a Kind is achieved. The player is paid another 10 credits for this hand in accordance with the pay table shown in Table 1. The credits won by the player for this Bonus Joker feature are accrued to the previous total on the Joker credit meter 46.

Figure 24:
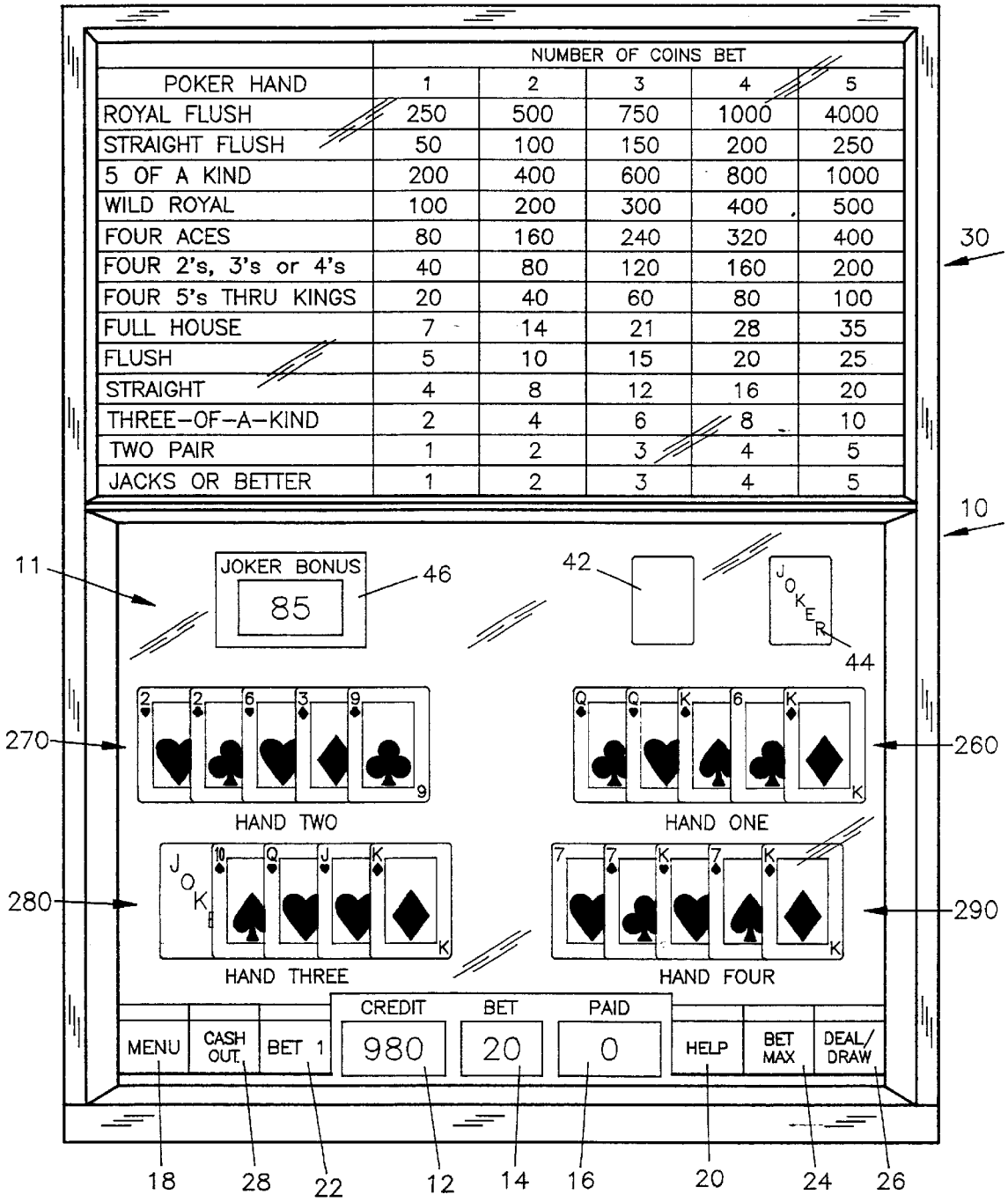
FIG. 24 shows the screen display after the "Black" Joker has been substituted for the first black card in the player's Hand Three.

This substitution of the Joker now proceeds to Hand Three 280. As shown in FIG. 24, the "Black" Joker 44 is first substituted for the Nine of Clubs in Hand Three 280 and the poker hand ranking of a Straight is achieved. The player is paid 20 credits for this hand in accordance with the pay table shown in Table 1. The credits won by the player for this Bonus Joker feature are shown on the Joker credit meter 46.

Figure 25:
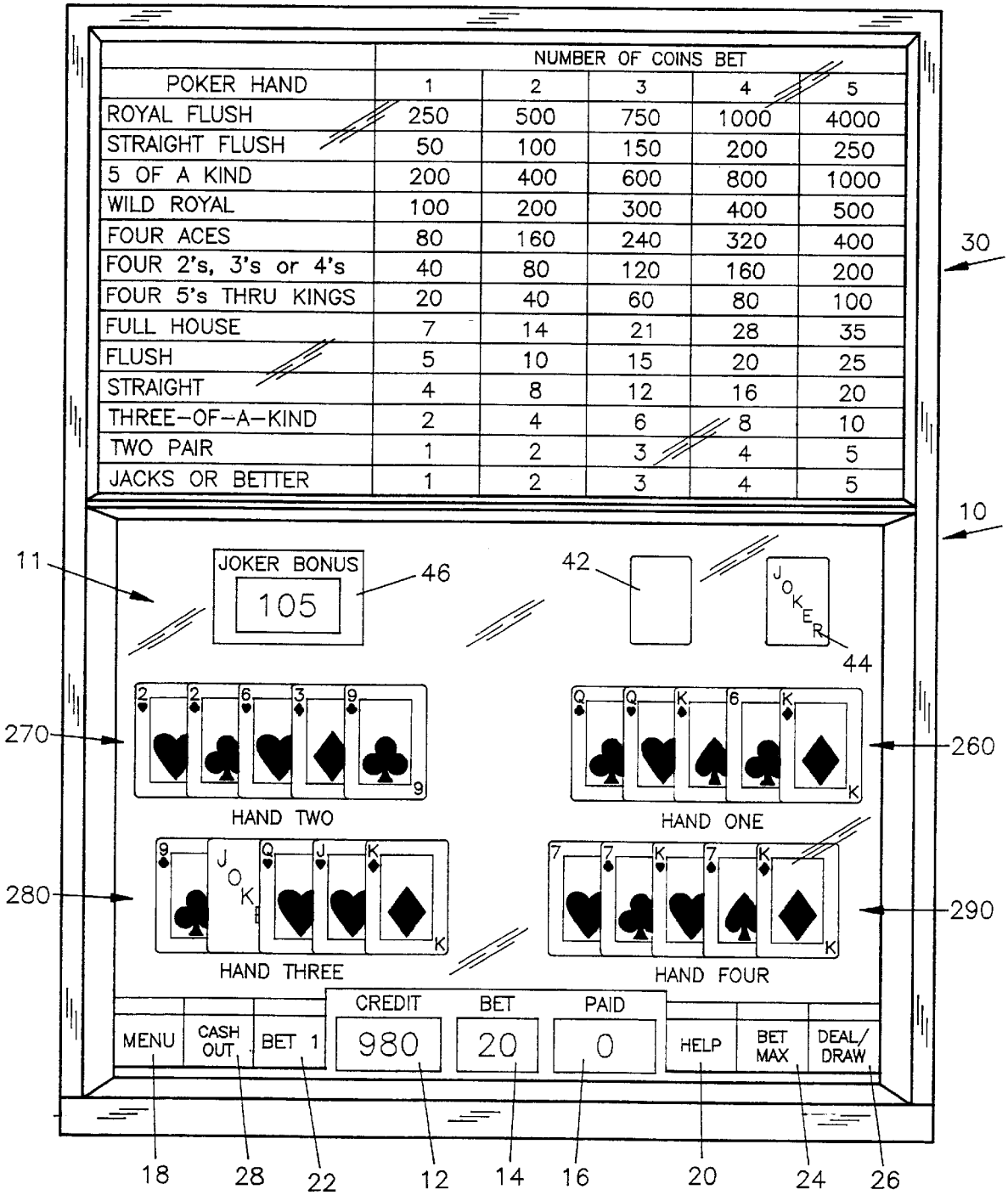
FIG. 25 shows the screen display after the "Black" Joker has been substituted for the second black card in the player's Hand Three.

Then, as shown in FIG. 25, the "Black" Joker 44 is substituted for the Ten of Spades in Hand Three 280 and the poker hand ranking of another Straight is achieved. The player is paid another 20 credits for this hand in accordance with the pay table shown in Table 1. The credits won by the player for this Bonus Joker feature are accrued to the previous total on the Joker credit meter 46.

Figure 26:
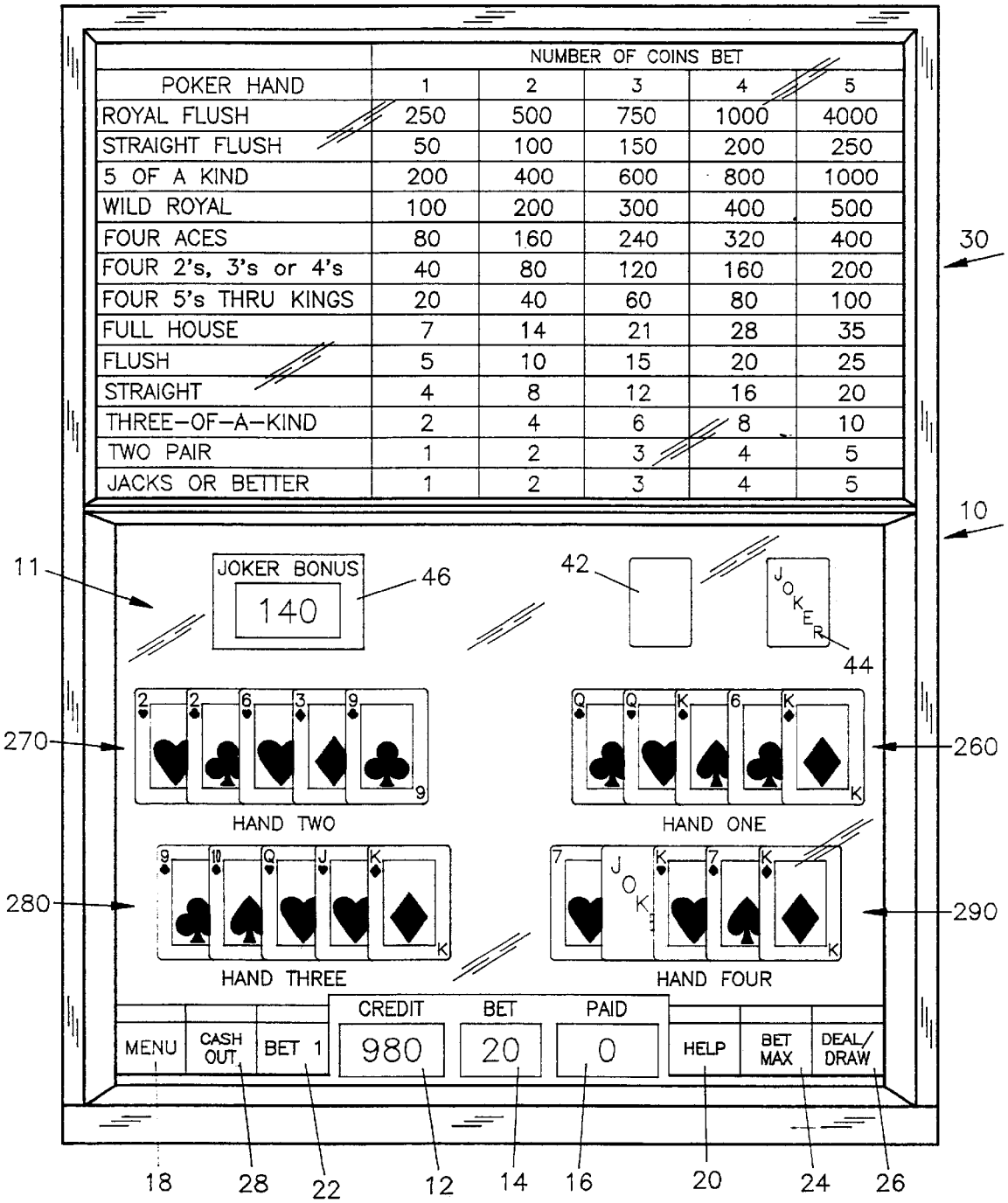
FIG. 26 shows the screen display after the "Black" Joker has been substituted for the first black card in the player's Hand Four.

Finally this substitution of the Joker now proceeds to Hand Four 290. As shown in FIG. 26, the "Black" Joker 44 is first substituted for the Seven of Clubs in Hand Four 290 and the poker hand ranking of a Full House is achieved. The player is paid 35 credits for this hand in accordance with the pay table shown in Table 1. The credits won by the player for this Bonus Joker feature are shown on the Joker credit meter 46.

Figure 27:
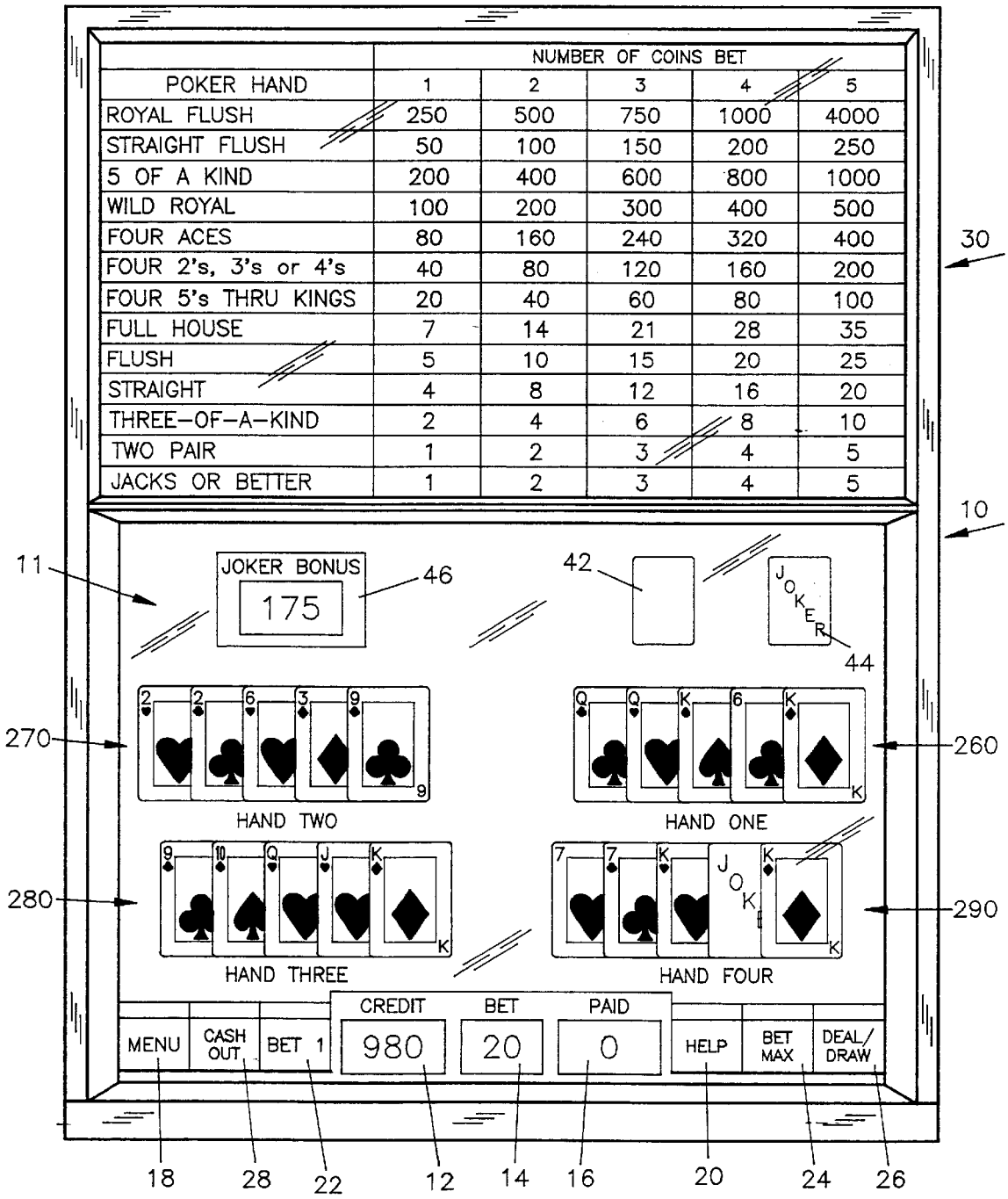
FIG. 27 shows the screen display after the "Black" Joker has been substituted for the second black card in the player's Hand Four.

The last substitution occurs as shown in FIG. 27, with the "Black" Joker 44 being substituted for the Seven of Spades in Hand Four 290 and the poker hand ranking of another Full House is achieved. The player is paid another 35 credits for this hand in accordance with the pay table shown in Table 1. The credits won by the player for this Bonus Joker feature are accrued to the previous total on the Joker credit meter 46.

Thus, on account of the player receiving the Black Joker 44 during the play of this round of the game, the player has won an additional 175 credits. At the conclusion of the joker substitution portion of the game, all of the credits won by the player that are shown on the Joker credit meter 46 are transferred to the main credit meter 12 and the gaming machine is ready for another round of the game.

If the player had randomly received the "Red" Joker instead of the "Black" Joker, the "Red" Joker would only have been substituted, one card location at a time, for each of the red cards in each of the four hands and poker hand rankings would be determined for each instance of substitution of the "Red" Joker. If the player had randomly received both the "Red" Joker and the "Black" Joker, each Joker would be substituted in order for its matching color cards in each hand and poker hand rankings would be determined for each instance of substitution.

The Bonus Joker feature of the present invention has been described in connection with a single "Black" Joker and/or a single "Red" Joker being randomly displayed on the video screen during the course of play. Other variations of displaying the Jokers may be used. In one variation, the activation of the Bonus Joker feature may require two or more, and most preferably four, of the full "Black" Jokers and/or the full "Red" Jokers to be displayed on the video screen. By requiring multiples of the full Jokers to be displayed on the screen to activate the Bonus Joker feature, the player can be enticed during the play of the game. For example if four full Jokers are required to activate the Bonus Joker feature, the computer controls of the gaming machine can randomly display one, two or three of the full Jokers during the deal and draw steps of the game so that the player can root along during the play of the game in hopes of achieving all four Jokers that the player needs to have the Bonus Joker feature activated.

Alternatively, portions or segments of a Joker may be randomly displayed during the play of the game with the Bonus Joker feature only being activated if the player achieves a full Joker. For example, each portion of a Joker can be displayed in quarter segments randomly during the deal and draw steps of the game. If the player achieves all four quarter portions of either the "Red" Joker or the "Black" Joker or both during the play of the game, the full Joker(s) achieved by the player cause the Bonus Joker feature to be activated.

The method of the present invention may be applied to any form of video poker such as Draw Poker, Wild Card poker (in which one or more cards are predesignated as wild cards) or Joker poker (in which one or more Jokers are added to the deck of cards and these added Jokers are used as wild cards).

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a draw poker game comprising:

a. dealing a player a first five card hand from a first deck of playing cards with two cards face up and three cards face down;

b. dealing the player a second five card hand from a second deck of playing cards with two cards face up and three cards face down;

c. dealing the player a third five card hand from a third deck of playing cards with two cards face up and three cards face down;

d. dealing the player a fourth five card hand from a fourth deck of playing cards with two cards face up and three cards face down;

e. the player selecting the two face up cards from one of the hands;

f. duplicating the two face up cards selected by the player as replacement cards for the two face up cards in the other hands;

g. revealing the face down cards in each hand;

h. for each hand, the player either standing or discarding one or more cards from the hand;

i. with regard to each hand position, dealing the player replacement cards for the discarded cards, if any;

j. determining a value for each hand based on poker hand ranking;

k. awarding the player a predetermined amount based on the value of each hand;

l. on a random basis, awarding the player a Red Joker or a Black Joker or both a Red Joker and a Black Joker during the play of the game; and m. if the player receives a Joker during the play of the game, substituting seriatim for each card in each final five card hand that corresponds to the color of the Joker, determining a poker hand ranking for each instance of substitution of the Joker and awarding the player additional payouts in accordance with the pay table for each poker hand ranking.

2. The method of claim 1 in which each deck of playing cards is a standard 52 card deck.

3. The method of claim 1 in which each deck of playing cards is a standard 52 card deck plus at least one extra Joker card which is treated as a wild card.

4. The method of claim 1 in which each deck of playing cards is a standard 52 card deck with at least one of the card being treated as a wild card.

5. The method of claim 1 in which the value of each hand is determined by comparing the poker hand ranking of the player's selected hand to a payout schedule.

6. The method of claim 5 in which the predetermined amount based on the value of each hand is based on a payout schedule.

7. The method of claim 6 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

8. The method of claim 1 further including a player wagering at least one coin to be eligible to participate in the game.

9. The method of claim 8 in which the predetermined amount that the player is paid is based on the number of coins wagered by the player.

10. The method of claim 1 in which the game is displayed on a video display screen on an electronic gaming machine.

11. A method of playing a draw poker game comprising:

a) dealing a player at least two five card hands, each five card hand being dealt from its own deck of playing cards and each five card hand being dealt with two cards face up and three cards face down;

b) the player selecting the two face up cards from one of the hands;

c) duplicating the two face up cards selected by the player as replacement cards for the two face up cards in the other hands;

d) revealing the face down cards in each hand;

e) for each hand, the player either standing or discarding one or more cards from the hand;

f) for each hand, dealing the player replacement cards for the discarded cards, if any;

g) determining a value for each hand based on poker hand ranking;

h) awarding the player a predetermined amount based on the value of each hand;

i) on a random basis, awarding the player a Red Joker or a Black Joker or both a Red Joker and a Black Joker during the play of the game; and j) if the player receives a Joker during the play of the game, substituting seriatim for each card in each final five card hand that corresponds to the color of the Joker, determining a poker hand ranking for each instance of substitution of the Joker and awarding the player additional payouts in accordance with the pay table for each poker hand ranking.

12. The method of claim 11 in which each deck of playing cards is a standard 52 card deck.

13. The method of claim 11 in which each deck of playing cards is a standard 52 card deck plus at least one extra Joker card which is treated as a wild card.

14. The method of claim 11 in which each deck of playing cards is a standard 52 card deck with at least one of the cards being treated as a wild card.

15.The method of claim 11 in which the value of each hand is determined by comparing the poker hand ranking of the player's selected hand to a payout schedule.

16. The method of claim 15 in which the predetermined amount based on the value of each hand is based on a payout schedule.

17. The method of claim 16 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

18. The method of claim 11 further including a player wagering at least one coin to be eligible to participate in the game.

19. The method of claim 18 in which the predetermined amount that the player is paid is based on the number of coins wagered by the player.

20. The method of claim 11 in which the game is displayed on a video display screen on an electronic gaming machine.

21. A method of playing a draw poker game comprising:

a) dealing a player at least two partial hands, each partial hand being dealt from its own deck of playing cards and each five card hand being dealt with two cards face up;

b) the player selecting the two face up cards from one of the hands;

c) duplicating the two face up cards selected by the player as replacement cards for the two face up cards in the other hands;

d) dealing three additional cards to each hand and displaying the additional cards face up;

e) for each hand, the player either standing or discarding one or more cards from the hand;

f) for each hand, dealing the player replacement cards for the discarded cards, if any;

g) determining a value for each hand based on poker hand ranking;

h) awarding the player a predetermined amount based on the value of each hand;

i) on a random basis, awarding the player a Red Joker or a Black Joker or both a Red Joker and a Black Joker during the play of the game; and j) if the player receives a Joker during the play of the game, substituting seriatim for each card in each final five card hand that corresponds to the color of the Joker, determining a poker hand ranking for each instance of substitution of the Joker and awarding the player additional payouts in accordance with the pay table for each poker hand ranking.

22. The method of claim 21 in which each deck of playing cards is a standard 52 card deck.

23. The method of claim 21 in which each deck of playing cards is a standard 52 card deck plus at least one extra Joker card which is treated as a wild card.

24. The method of claim 21 in which each deck of playing cards is a standard 52 card deck with at least one of the cards being treated as a wild card.

25. The method of claim 21 in which the value of each hand is determined by comparing the poker hand ranking of the hand to a payout schedule.

26. The method of claim 25 in which the predetermined amount based on the value of each hand is based on a payout schedule.

27. The method of claim 26 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

28. The method of claim 21 further including a player wagering at least one coin to be eligible to participate in the game.

29. The method of claim 28 in which the predetermined amount that the player is paid is based on the number of coins wagered by the player.

30. The method of claim 21 in which the game is displayed on a video display screen on an electronic gaming machine.

31. A method of playing a draw poker game comprising:

a) dealing a player a first five card hand from a first deck of playing cards with two cards face up and three cards face down;

b) dealing the player a second five card hand from a second deck of playing cards with two cards face up and three cards face down;

c) dealing the player a third five card hand from a third deck of playing cards with two cards face up and three cards face down;

d) dealing the player a fourth five card hand from a fourth deck of playing cards with two cards face up and three cards face down;

e) the player selecting the two face up cards from one of the hands as the hand to be played;

f) revealing the face down cards in the selected hand;

g) the player either standing on the selected hand or discarding one or more cards from the selected hand;

h) dealing the player replacement cards for the discarded cards, if any;

i) determining a value for the player's selected hand based on poker hand ranking;

j) awarding the player a predetermined amount based on the value of the player's selected hand;

k) on a random basis, awarding the player a Red Joker or a Black Joker or both a Red Joker and a Black Joker during the play of the game; and l) if the player receives a Joker during the play of the game, substituting seriatim for each card in the selected five card hand that corresponds to the color of the Joker, determining a poker hand ranking for each instance of substitution of the Joker and awarding the player additional payouts in accordance with the pay table for each poker hand ranking.

32. The method of claim 31 in which each deck of playing cards is a standard 52 card deck.

33. The method of claim 31 in which each deck of playing cards is a standard 52 card deck plus at least one extra Joker card which is treated as a wild card.

34. The method of claim 31 in which each deck of playing cards is a standard 52 card deck with at least one of the cards being treated as a wild card.

35. The method of claim 31 in which the value of the player's selected hand is determined by comparing the poker hand ranking of the player's selected hand to a payout schedule.

36. The method of claim 35 in which the predetermined amount based on the value of the player's selected hand is based on a payout schedule.

37. The method of claim 36 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

38. The method of claim 31 further including a player wagering at least one coin to be eligible to participate in the game.

39. The method of claim 38 in which the predetermined amount that the player is paid is based on the number of coins wagered by the player.

40. The method of claim 31 in which the game is displayed on a video display screen on an electronic gaming machine.

41. A method of playing a draw poker game comprising:

a) dealing a player at least two five card hands, each five card hand being dealt from its own deck of playing cards and each five card hand being dealt with two cards face up and three cards face down;

b) the player selecting the two face up cards from one of the hands, said hand being a selected hand;

c) revealing the face down cards in the selected hand;

d) the player either standing on the selected hand or discarding one or more cards from the selected hand;

e) dealing the player replacement cards for the discarded cards, if any;

f) determining a value for the player's selected hand based on poker hand ranking;

g) awarding the player a predetermined amount based on the value of the player's selected hand;

h) on a random basis, awarding the player a Red Joker or a Black Joker or both a Red Joker and a Black Joker during the play of the game; and i) if the player receives a Joker during the play of the game, substituting seriatim for each card in the selected five card hand that corresponds to the color of the Joker, determining a poker hand ranking for each instance of substitution of the Joker and awarding the player additional payouts in accordance with the pay table for each poker hand ranking.

42. The method of claim 41 in which each deck of playing cards is a standard 52 card deck.

43. The method of claim 41 in which each deck of cards is a standard 52 card deck plus at least one extra Joker card which is treated as a wild card.

44. The method of claim 41 in which each deck of playing cards is a standard 52 card deck with at least one of the cards being treated as a wild card.

45. The method of claim 41 in which the value of the player's selected hand is determined by comparing the poker hand ranking of the player's selected hand to a payout schedule.

46. The method of claim 45 in which the predetermined amount based on the value of the player's selected hand is based on a payout schedule.

47. The method of claim 46 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

48. The method of claim 41 further including a player wagering at least one coin to be eligible to participate in the game.

49. The method of claim 48 in which the predetermined amount that the player is paid is based on the number of coins wagered by the player.

50. The method of claim 41 in which the game is displayed on a video display screen on an electronic gaming machine.

51. The method of playing a five-card draw poker game comprising:

a) dealing a player at least two partial hands, each partial hand being dealt from its own deck of playing cards and each partial hand being dealt with two cards face up;

b) the player selecting the two face up cards from one of the hands to create a selected hand;

c) dealing three additional cards to the selected hand and displaying the additional cards face up;

d) the player either standing on the selected hand or discarding one or more cards from the selected hand;

e) dealing the player replacement cards for the discarded cards, if any;

f) determining a value for the selected hand based on poker hand ranking;

g) awarding the player a predetermined amount based on the value of the selected hand;

h) on a random basis, awarding the player a Red Joker or a Black Joker or both a Red Joker and a Black Joker during the play of the game; and i) if the player receives a Joker during the play of the game, substituting seriatim for each card in the selected hand that corresponds to the color of the Joker, determining a poker hand ranking for each instance of substitution of the Joker and awarding the player additional payouts in accordance with the pay table for each poker hand ranking.

52. The method of claim 51 in which each deck of playing cards is a standard 52 card deck.

53. The method of claim 51 in which each deck of playing cards is a standard 52 card deck plus at least one extra Joker card which is treated as a wild card.

54. The method of claim 51 in which each deck of playing cards is a standard 52 card deck with at least one of the cards being treated as a wild card.

55. The method of claim 51 in which the value of the selected hand is determined by comparing the poker hand ranking of the selected hand to a payout schedule.

56. The method of claim 55 in which the predetermined amount based on the value of the selected hand is based on a payout schedule.

57. The method of claim 56 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5. |

58. The method of claim 51 further including a player wagering at least one coin to be eligible to participate in the game.

59. The method of claim 58 in which the predetermined amount that the player is paid is based on the number of coins wagered by the player.

60. The method of claim 51 in which the game is displayed on a video display screen on an electronic gaming machine.

* * * * *